US005230709A

United States Patent [19]

Holfeld et al.

[11] Patent Number: 5,230,709

[45] Date of Patent: Jul. 27, 1993

[54] POLYAMIDE DYEING PROCESS UTILIZING CONTROLLED ANIONIC DYE ADDITION

[75] Inventors: Winfried T. Holfeld; Dale E. Mancuso, both of Wilmington, Del.

[73] Assignee: E. I. Du Pont de Nemours and Company, Wilmington, Del.

[21] Appl. No.: 745,044

[22] Filed: Aug. 14, 1991

Related U.S. Application Data

[63] Continuation-in-part of Ser. No. 614,535, Nov. 15, 1990, abandoned.

[51] Int. Cl.[5] ..... D06P 5/00

[52] U.S. Cl. ..... 8/400; 8/504; 8/676; 8/680; 8/924

[58] Field of Search ..... 8/400, 504, 680

[56] References Cited

U.S. PATENT DOCUMENTS

| | | | |
|---|---|---|---|
| 3,966,406 | 6/1976 | Namiki et al. | 8/636 |
| 4,089,644 | 5/1978 | Carbonell et al. | 8/400 |
| 4,125,371 | 11/1978 | Beutler et al. | 8/400 |
| 4,351,076 | 9/1982 | von der Eltz et al. | 8/149.1 |
| 4,371,485 | 2/1983 | Mathes et al. | 264/46.1 |
| 4,372,744 | 2/1983 | Hildebrand et al. | 8/400 |
| 4,483,032 | 11/1984 | Christ et al. | 8/149.1 |
| 4,629,465 | 12/1986 | Hasler et al. | 8/400 |
| 4,668,241 | 5/1987 | Magni et al. | 8/638 |
| 4,820,312 | 4/1989 | von der Eltz | 8/533 |
| 4,885,814 | 12/1989 | von der Eltz et al. | 8/149.1 |
| 5,114,427 | 5/1992 | Damm | 8/400 |

FOREIGN PATENT DOCUMENTS

| | | |
|---|---|---|
| 2624176 | 12/1983 | Fed. Rep. of Germany . |
| 2823534 | 11/1987 | Fed. Rep. of Germany . |
| 1299777 | 12/1972 | United Kingdom . |

OTHER PUBLICATIONS

H. Heilweil, TRI Notes on Research, No. 414, Jul. 1988.

J. Cegarra, P. Puente, J. Valldeperas, and M. Pepio, Textile Research Journal, 645-653, Nov. 1988.

A. A. Vaidya, *Textile Auxiliaries and Finishing Chemicals* (1975), pp. 27-28.

E. Merian and U. Lerch, American Dyestuff Reporter, 695-702, Sep. 17, 1962.

R. McGregor, Canadian Textile Journal, 61-68, May 1973.

W. Holfeld & M. Shephard, Textile Chemist and Colorist, a reprint from vol. 10, No. 2-3, Feb. and Mar. 1978.

*Primary Examiner*—A. Lionel Clingman

[57] ABSTRACT

A process for the dyeing of a fibrous article containing fibers of a polyamide polymer with an anionic dye and dyed products made by the process. The process includes immersing the article in a dyeing bath of a liquid solvent for the anionic dye. The liquid solvent and the article are heated to a temperature at least equal to the dyeing transition temperature of the fiber of polyamide polymer. The anionic dye is added to the dyeing bath as a miscible liquid concentrate at a dye addition rate during a controlled dye addition period. At least a portion of the dye is added while the solvent and the article are at a temperature at least equal to the dyeing transition temperature. Stirring of the bath during the dye addition period and while the solvent and article are at a temperature at least equal to the dyeing transition temperature is done to mix the dye concentrate with the solvent in the bath to form a dilute dye solution and to provide a flow of the dilute dye solution relative to the article to cause the dye to be transported to the article. The stirring also provides, on the average, essentially uniform dye transport of the anionic dye to the article. The dye addition rate is adjusted at least while the solvent and article are at a temperature at least equal to the dyeing transition temperature so that the dye addition rate is the primary control over the rate of dye uptake by the article.

27 Claims, 15 Drawing Sheets

2

10

POLYAMIDE DYEING PROCESS UTILIZING CONTROLLED ANIONIC DYE ADDITION

This is a continuation-in-part of application Ser. No. 07/614,535, filed Nov. 15, 1990 and abandoned.

BACKGROUND OF THE INVENTION

The present invention relates to the dyeing of fibrous articles containing polyamide fibers with anionic dyes.

Anionic dyes such as acid dyes and pre-metallized dyes are widely used for the dyeing of polyamide fibers in which the nitrogen-containing groups of the polyamide polymer serve as dye sites. In conventional dyeing processes using such dyes, articles containing the polyamide fibers are immersed in an aqueous bath containing a solution of the dye after any pre-treatment processes such as scouring. While a wide variety of dyeing equipment is used, it is typical for all of the dye to be used in the process to be present in the bath initially. The bath containing the dye and the article to be dyed is also usually at a very low initial temperature, e.g., 80°-120° F. (26.7°-48.9° C.) increased gradually to an elevated temperature often as high as the boiling point as the dyeing progresses.

While high quality dyeing can be achieved using the conventional dyeing process for some acid dyes such as small molecule "levelling" dyes, dye cycles to achieve levelling with such anionic dyes are sometimes extremely long and are therefore costly. Moreover, with large molecule acid and pre-metallized dyes which are desirable for applications requiring good light and/or wash fastness, there are often severe dye uniformity problems associated with the conventional dyeing process.

Large molecule acid and pre-metallized dyes are often referred to as "structure sensitive" dyes since non-uniform dyeing can result from even minor, and otherwise undetected, variations in the fiber physical structure. While dye-levelling and/or retarding agents can be added to the dye bath to improve dyeing uniformity, such agents sometimes provide only limited increases in dye uniformity and usually have disadvantages including increased initial expense and higher cost to treat the spent dyeing bath. In addition, because of their retarding effect, such chemical agents can sometimes increase dyeing cycles or make it difficult to obtain deep colors or dark shades. Also, dye yields from anionic dyes, i.e., the strength of color produced from a given quantity of dye on the fiber, are sometimes not as high as desired.

SUMMARY OF THE INVENTION

The invention provides an improved process for the dyeing of a fibrous article containing fibers of a polyamide polymer with at least one anionic dye and dyed products made by the process. A process in accordance with the invention includes immersing the article in a dyeing bath of a liquid solvent for the anionic dye. The liquid solvent and the article are heated to a temperature at least equal to the dyeing transition temperature of the fiber of polyamide polymer. The anionic dye is added to the dyeing bath as a miscible liquid concentrate at a controlled dye addition rate during a dye addition period. At least a portion of the dye is added while the bath and article are at temperature at least equal to the dyeing transition temperature. Stirring of the bath during the dye addition period and while the solvent and article are up to the dyeing transition temperature is done to mix the dye concentrate with the solvent in the bath to form a dilute dye solution and to provide a flow of the dilute dye solution relative to the article to cause the dye to be transported to the article. The stirring also provides, on the average, essentially uniform dye transport of the anionic dye to the article. In accordance with the process, the dye rate is adjusted at least while the solvent and article are at a temperature at least equal to the dyeing transition temperature so that the dye addition rate is the primary control over the rate of dye uptake by the article.

In accordance with a preferred form of the invention, the conditions in the liquid solvent are maintained so that the anionic dye transfers less than about 10%.

In accordance with another preferred form of the invention, the process is performed in a dyeing machine in which the stirring provides a number of repetitive machine cycles and the dye addition rate is adjusted so that an amount of dye between about 0.5% and about 7% of the total dye is added to the dyeing bath during a machine cycle, most preferably between about 0.5% and about 3%.

In accordance with another preferred form of the invention, stirring is performed generally constantly and at a constant rate in the bath at least while the solvent and the article are at a temperature at least equal to the dyeing transition temperature.

In accordance with another preferred form of the invention, the dye is added continuously and at a constant rate during the dye addition period.

In accordance with another preferred form of the invention, at least about 33% of the dye is added to the bath while said solvent and said article are at a temperature at least equal to the dyeing transition temperature, most preferably at least about 50% of the dye is added at this time.

In accordance with another preferred form of the invention, the dye addition rate is adjusted so that the concentration of dye at location of lowest concentration in the bath is not greater than about 100 times, most preferably not greater than 50 times, the final equilibrium concentration for any substantial period of time while the solvent and the article are at a temperature at least equal to the dyeing transition temperature.

In accordance with another preferred form of the invention, the rate of dye addition is adjusted so that the concentration of dye in the solvent as measured at the point of lowest concentration in the bath is at least about 2.5 times, preferably at least about 3.5 times, the final equilibrium concentration for a sustained period of time while the solvent and the article are at a temperature at least equal to the dyeing transition temperature. Preferably, the sustained period of time comprises at least about 10% of the time when the solvent and the article are at a temperature at least equal to the dyeing transition temperature.

In accordance with a preferred embodiment of the invention, the liquid dye concentrate is added into the solvent ahead of a circulation pump to form the dilute dye solution. Preferably, the liquid dye concentrate is added to the solvent using a metering pump.

In accordance with another preferred form of the invention, the process further includes the step of hydrosetting before dyeing.

In accordance with a preferred product in accordance with the invention, a dyed fabric is provided which comprises yarns containing fibers of a polyamide polymer. The dyed fabric contains at least one anionic dye with the dye being distributed in the fabric such that:

the fibers are asymmetrically ring-dyed; and the fibers adjacent to the yarn outside surfaces contain more dye than fibers in the yarn interiors.

In a preferred form of the dyed fabric in accordance with the invention, fibers adjacent to at least one of the front and back fabric surfaces of the fabric contain more dye than in the fabric interior In accordance with a preferred form of the fabric of the invention, the fabric is selected from the class consisting of knitted and woven fabrics, most preferably wherein the fibers are continuous filaments.

The invention is useful in a wide variety of polyamide dyeing processes using anionic dyes and is particularly advantageous when employed to dye articles such as warp knit and woven fabrics in jet dyeing apparatus. In addition, the invention also is particularly useful for the dyeing of carpets in beck dyers. Surprisingly, it has been found that when used under conditions such that the dyes transfer less than 10%, anionic dyes are utilized more effectively which provides either better dye yields or the achievement of deep colors or dark shades which were otherwise difficult to obtain or were unobtainable. Also, dye cycles for all types of dyes can be substantially shortened. With structure sensitive anionic dyes, better uniformity is easily achieved even when two or more dyes are used which have differing rates of dye uptake. Moreover, the improvements in dyeing are often achievable without the use of or by using lower concentrations of chemical levelling or other chemical agents which, in significant concentrations, can complicate treatment of spent dyeing bath liquids.

DETAILED DESCRIPTION

Figure 1:
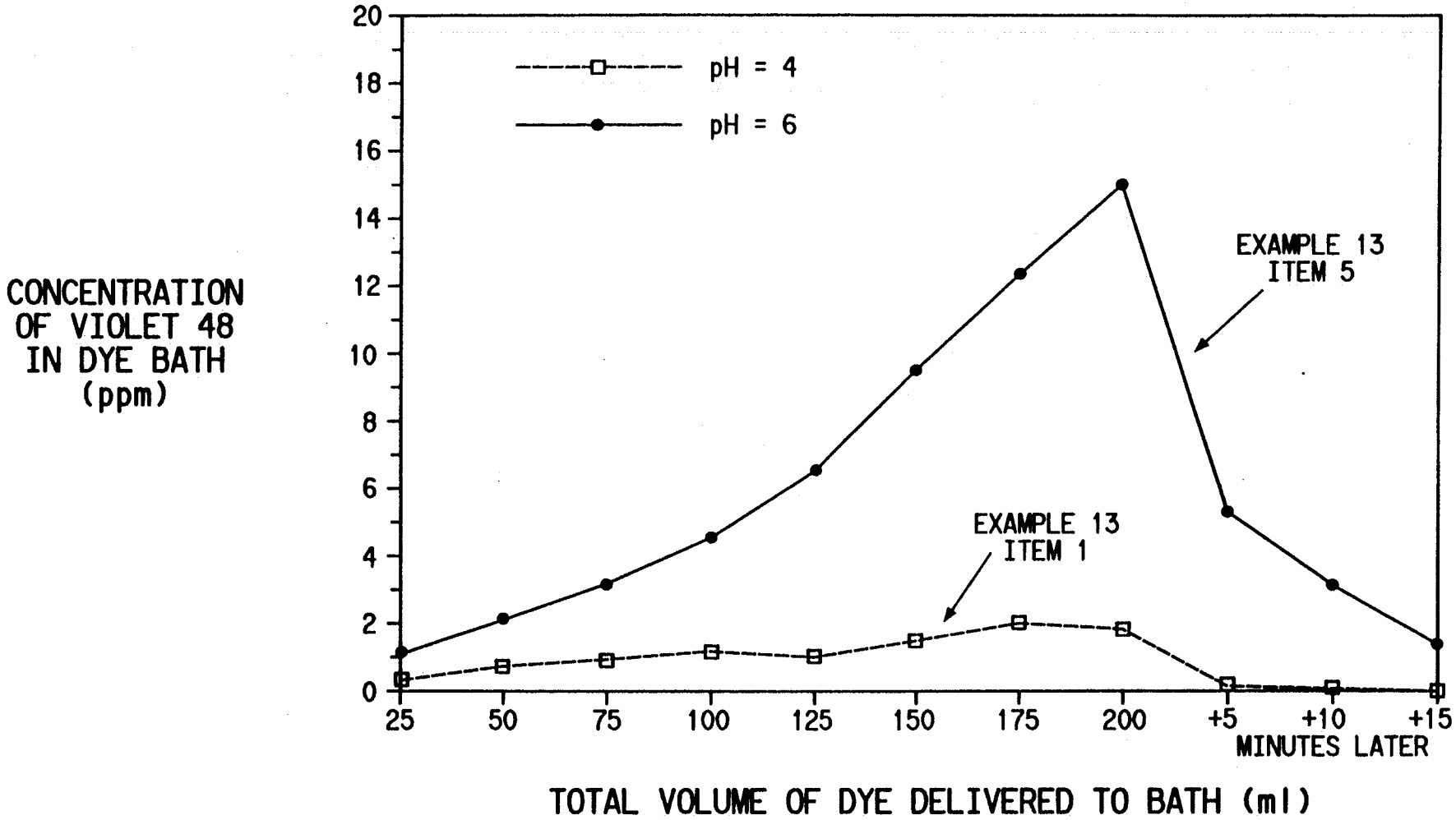
FIG. 1 is a graphical representation of the concentration of dye in a dye bath with respect to volume of dye concentrate added to the bath for a lab scale jet dyeing process in accordance with the invention (Example 13, Items 1 and 5)

The process of the invention is useful for dyeing articles containing fibers of a variety of polyamides. The invention is particularly useful for fibers made from aliphatic polyamide homopolymers and copolymers which are melt-spinnable to form fibers which are amenable to processing for textile uses. A preferred class of such polyamides contains at least one of poly(hexamethylene adipamide) or poly(ε-caproamide) polymer units in an amount greater than about 60% by weight. A most preferred class of polyamides contains at least about 85% by weight poly(hexamethylene adipamide). In the examples which follow, homopolymer poly(hexamethylene adipamide) is referred to as 66 nylon.

There are a wide variety of fibrous articles containing polyamide fibers which can be dyed using the process of the invention including, for example, yarns, fabric, carpets and garments. Fabrics include the usual textile forms including woven, knitted, and nonwoven varieties. The polyamide fiber in such articles can be present in a wide variety of forms including flat or textured continuous filaments, staple yarns, bulked continuous filaments, etc. The polyamide fiber can be present in the article together with any of a variety of other synthetic or natural fibers. Typical of such articles are staple yarns made from a "blend" of polyamide staple with other fibers and fabrics and garments made from such yarns. The invention is particularly useful with fabrics containing continuous filament polyamide yarns together with elastic fibers such as spandex sold under the trademark Lycra® by E. I. du Pont de Nemours & Company. The other fibers in such articles may or may not undergo dyeing as the polyamide fibers are dyed in the process. In addition, the polyamide fibers to be dyed may already contain the same or a different dye. For example, the process of the invention may be used for a dye "add" to get to "shade" with the fiber already containing most of the dye before the process is used.

The dyes used in the practice of the present invention are anionic dyes and dyeing of the polyamide fiber is accomplished by uptake of the dyes through the association of the dye molecules with nitrogen-containing groups on the polyamide polymer molecules. Most anionic dyes are members of the well-known class of "acid" dyes. Another type of anionic dyes is the type referred to as "pre-metallized" dyes which are the reaction products of, for example, chromium or cobalt and selected dyes. As will become apparent hereinafter, mixtures of two or more dyes are often used to achieve a desired shade. In this application, the word "dye" may be used to refer to a single dye or multiple dyes as in a mixture of dyes used in a dyeing process or on a dyed article. In processes using more than one dye such as in dye mixtures to achieve compound shades, a process is intended to be within the scope of the invention provided that at least one dye of compound shade is applied to an article in accordance with the invention.

In accordance with a preferred process in accordance with the invention, conditions are used in the dye bath so that anionic dyes transfer less than about 10%. Transfer is a measure of the propensity of anionic dyes to migrate from one dye site to another after being absorbed by the fiber. Transfer under a given set of conditions can be measured in a mock dye bath as in the transfer test method described hereinafter.

Providing transfer of less than 10% can easily be accomplished by use of dyes from a preferred class of dyes, the "structure sensitive" anionic dyes. These dyes are usually large molecule acid ("milling") dyes or pre-metallized dyes which are non-levelling, i.e., the dye molecules do not "transfer" significantly and thus migrate very little from one dye site to another after being absorbed by the fiber. Typically, structure sensitive dyes "transfer" less than 10% under normal conditions of use. "Structure sensitive" is the term applied to such dyes since non-uniform dyeing can result from even minor, and otherwise undetected, variations in the fiber physical structure. Such variations arise from the cumulative effects of thermal, mechanical, and chemical energy inputs during fiber manufacturing (including finish application) and in subsequent textile processing. Despite their known difficulties in use, structure sensitive dyes are desirable for many applications due to their washfastness, lightfastness, or both.

Without intending to limit this preferred form of the invention to these specific dyes, commonly used structure-sensitive dyes are represented, for example, by the list provided below (C.I. refers to the Color Index, 3rd edition, 1971):

Highly Structure Sensitive

C.I. Acid Green 28
C.I. Acid Blue 290
C.I. Acid Blue 264
C.I. Acid Violet 54
Nylanthrene Blue GLF[1]
[1]Crompton & Knowles Corp., Charlotte, N.C. 28233
Tectilon Fast Blue RW[2]
[2]Ciba-Geigy Corp., Dyestuffs & Chemicals Div., Greensboro, N.C. 27419-8300
C.I. Acid Violet 103
C.I. Acid Violet 48
C.I Acid Blue 122
C.I. Acid Blue 280
C.I Acid Red 182
C.I. Acid Brown 45

Moderately Structure Sensitive

C.I. Acid Orange 116
C.I. Acid Blue 230
C.I. Acid Red 114

Structure sensitive (rate sensitive) dyes are discussed in more detail in Textile Chemist and Colorist, Vol. 17, No. 12, p.231 (1985).

For dyes which are normally described as "levelling" dyes since they transfer readily and "level" under the normal conditions of use, transfer of less than about 10% can be accomplished using conditions of low pH, low temperature, or both. In addition, with dyes which are normally strongly levelling, it may be necessary to perform the dyeing rapidly even though the conditions in the dyeing bath are such that the dye transfers less than about 10%. Otherwise, the dye yield benefits which are otherwise obtainable using the invention may be diminished due to dye transfer which occurs after the dye is on the article.

As in conventional dyeing processes, it is desirable to scour the article before dyeing to remove yarn finishes, sizing and other materials which may adversely affect the dyeing. In the use of the invention for dyeing warp knit fabrics, particularly for critical dye applications, it is important for the fabrics to be effectively scoured before dyeing. The fabrics can be scoured, for example, in an open width scouring range or in the apparatus to be used for the dyeing, e.g., a jet or beam dyer. Scouring solutions used conventionally are generally suitable, e.g., water at 180° F. (82.2° C.) containing a surfactant such as 0.5 gram/liter of MERPOL LFH® (a liquid non-ionic detergent sold by E. I. Du Pont de Nemours & Company, Inc. of Wilmington, Del.). After scouring, the fabric should be rinsed such as by being immersed in hot water.

As is done for known dyeing processes, it is desirable to heat-set some warp knit fabrics such as tricot before dyeing to stabilize the fabric and prevent "edge curling" which can cause unlevel dyeing. It is particularly desirable to heat-set elastic tricot fabrics since these fabric have a strong propensity to edge curl. It may be advantageous to dry and heat-set scoured fabrics in a single step such as in a pin tenter. Trimming the edges of the fabric during heat-setting may also assist in minimizing edge curling during dyeing.

Another particularly advantageous technique for some fabrics such as warp knit fabrics for automotive uses is to hydroset the fabrics as part of the dyeing process. "Hydrosetting" is intended to refer to heating the fabric to a temperature sufficient to reduce yarn to yarn structure differences and "set" the yarns in the fabric while the fabric is in contact with liquid water. Usually, the water should be free of substantial quantities of chemicals or impurities. Hydrosetting can eliminate the heat-setting step and provide further increases in dye uniformity over the increased uniformity otherwise provided by the dyeing process of the invention. While hydrosetting can be done in an autoclave, hydrosetting can easily be accomplished in a process in accordance with the invention by hydrosetting in the dyeing bath but before any dye or other chemicals are added. This is a particularly useful technique when the dyeing is to be done in a jet dyer since most jet dyers have the capability to be pressurized to achieve the preferred temperatures. For 66 nylon, the bath is heated to a temperature of at least about 190° F. (87.8° C.), preferably between about 220° F. (104.4° C.) and about 270° F. (132.2° C.) for a time period between about 1 and 5 minutes. Usually, temperatures required for 6 nylon and 66 nylon copolymers are lower. Hydrosetting is referred to, for example, in U.S. Pat. No. 4,731,485 at column 11, lines 43–47.

In the process of the invention, the article to be dyed is immersed in a dyeing bath containing a liquid solvent for the anionic dye. The dyeing bath can take a wide variety of forms in which the article is totally immersed in the bath throughout the dyeing process or is partially immersed at any one time and is moved in a cyclical or random fashion to provide contact for the entire article with the solvent. Partial immersion is useful for articles such as fabrics where the fabric can be progressively advanced through the bath, either in continuous rope form or by reciprocation of an article having a discrete length, so that the entire article is ultimately dyed.

A preferred process employs the bath formed in a jet-dyeing apparatus for fabric in which the fabric is in the form of an endless rope and is moved by means of a jet nozzle supplied with solvent pumped from the bath. Machines of this type include a jet-dyeing machine (Gaston County Dyeing Machine Company), a circular jet-dyeing machine (Hisaka Works, Ltd.), "Uni-Ace" dyeing machine (Nippon Dyeing Machine Company), HT dyeing machine "Loco-Overflow" (Hokuriku Chemical Machinery Co. Ltd.), "Masflow" installation (Masuda Manufacturing Co., Ltd.), and the like.

When the fabric is loaded into a jet dyer for the practice of the preferred form of the invention and sewn at its ends to form the rope, it is preferable to use a straight, unbiased seam to minimize the chances of non-uniformity due to bias seaming. In larger scale processes, it has been found that tacking of the fabric rope into a tube is usually not desirable since tacking can impede access of the dye to the fabric. The jet dyer should be set up with a suitable jet nozzle to allow for complete reorientation of the fabric during dyeing and a suitable turnover rate should be provided as will become more apparent hereinafter. It is also usually desirable to avoid overcrowding in the kier and thus the amount of fabric to be dyed should be limited appropriately.

The liquid solvent for the dye is any suitable solvent for the dye which is capable of transporting the dye to the dye sites on the fiber and which is otherwise compatible with the fabric, dye and other aspects of the process, e.g., aqueous liquids and methanol are suitable solvents. Preferably, the liquid solvent is an aqueous liquid which contains less than about 10% by weight of additives for establishing and maintaining the desired pH and for other purposes Suitable aqueous liquids useful in the process contain additives for providing a buffer system. For example, acetic acid on the order of about 1% and ammonium acetate on the order of about 2% by weight can be used to adjust the pH to a suitable level. Other additives can be chemicals such as levelling agents, retarders, and the like which are referred to collectively in the present application as "dyeing auxiliaries". Dyeing auxiliaries can be present in the process of the invention although such agents often are not needed. If dyeing auxiliaries are present in the bath, a much lower concentration is typically used to keep the dye cycle to a reasonably short duration. Dyeing auxiliaries can be useful and may be desirable for compound shades of dyes of differing affinities.

When the bath has low levels of or is substantially free of dyeing auxiliaries, significant advantages are obtained in the treatment or disposal of the spent dye liquors. Moreover, the dyed fiber may be substantially free of residual dyeing auxiliaries or such agents may be present only at much lower levels than in fibers dyed by the conventional process for structure sensitive dyes which typically require high bath concentrations of dyeing auxiliaries. In addition, it is possible in some instances to use the spent dyeing bath for after-treatments such as for improving wetfastness, lightfastness or softness, applying antistats, and for other known after-treatments employing chemical agents. For such after treatments, the chemical agent can be added to the hot bath using a technique similar to that used to add the dye in a process in accordance with the invention. In addition, it is also possible to reuse the spent bath in a subsequent dyeing if dyeing auxiliaries are absent or are present in sufficiently low concentration.

The anionic dye is added to the dyeing bath ad a miscible liquid concentrate at a controlled dye addition rate during a dye addition period. "Dye addition period" refers to the time period beginning with the first addition of dye and ending with the final amount of dye being added. The length of the dye addition period will usually range between about 5 minutes and about 4 hours with typical dye addition periods being between about 20 and about 100 minutes. Upon stirring as will be explained in more detail, the miscible liquid dye concentrate is mixed with the solvent in the bath to form a dilute dye solution. "Miscible liquid concentrate" is intended to refer to a solution in which the dye is fully dissolved and which can be added to and mixed with the liquid solvent in the bath to form a dilute liquid solution of the dye in all proportions of such concentrates which would normally be mixed into a dye bath. The solvent for the miscible liquid concentrate can be different than the liquid solvent provided that the introduction of a different solvent does not otherwise adversely affect the dyeing process. When an aqueous dyeing bath is used, the solvent preferably used in the miscible liquid concentrate is water.

As will be explained in more detail hereinafter, the dye addition rate is adjusted depending on the amount of dye to be applied, the characteristics of the article to be dyed, the type of dyeing apparatus, the type of dye and the conditions of the dyeing to achieve the desired results. Preferably, to facilitate control over the process and make the process more easily reproducible, the dye is added continuously and at a constant rate during the dye addition period.

In processes in which the dilute dye solution in the bath is circulated by means of a circulation pump, the liquid dye concentrate is preferably added to the solvent ahead of the circulation pump. A metering pump is advantageously utilized for this purpose. Preferably, when dyeing fabric in a jet dyer, the circulation pump supplies the dilute dye solution to the jet nozzle so that the newly-added dye contacts the fabric first in the jet.

In a process in accordance with the invention, the dye bath containing the solvent and the article in the dyeing bath are heated to a temperature at least equal to the dyeing transition temperature. For the purposes of this application, dyeing transition temperature refers to the temperature during dyeing with a particular dye at which the fiber structure opens up sufficiently to allow a marked increase in the rate of dye uptake. The dyeing transition temperature for a dye/fiber combination may be determined by running a dyeing under the condition to be used and plotting % dye exhaust with respect to dye bath temperature when increased at 3° C./min. The temperature at 15% exhaust is the dyeing transition temperature. If more than one dye is to be used in a dyeing process, the temperature in the dyeing process is preferably at least equal to the dyeing transition temperature of the dye having the highest dyeing transition temperature (usually also the most structure sensitive). In the preferred form of the invention using jet dyeing apparatus, heating can be achieved using a heat exchanger through which liquid from the bath is circulated externally.

In a process in accordance with the invention, at least a portion of the dye is added while the solvent and the article are at a temperature at least equal to the dyeing transition temperature. This part of the dyeing process can be referred to as the "rapid dye uptake phase", i.e., the time period where there is dye in the bath and the solvent and article are at a temperature at least equal to the dyeing transition temperature. In a process where no dye is added to the bath until the solvent and article are at least equal to the dyeing transition temperature, the rapid dye uptake phase will begin when dye is first added to the bath. In a process where dye addition is begun before the bath is up to temperature, the rapid dye uptake phase will begin when the solvent and article reach a temperature at least equal to the dyeing transition temperature. In typical processes, the rapid dye uptake phase will end when the bath is exhausted toward or at the end of the dyeing process.

During the rapid dye uptake phase in one preferred process in accordance with the invention, the temperature of the bath and the article in the bath is maintained generally constant so that the dyeing process is not affected by temperature changes which may affect the rate of dye uptake by the article. Generally, provided that the temperature remains above the dyeing transition temperature, the temperature should be controlled to within ±10° C., preferably ±5° C. Also, in aqueous systems, it is usually preferable for the pH to be maintained generally constant. It has been found that controlling the pH to within about ±0.2 units is suitable.

In some processes, particularly processes using a dye mixture where one dye is structure sensitive and the other is strongly levelling, it may be desirable to decrease the pH and/or lower the temperature as the dyeing progresses to promote the exhaustion of the levelling dye from the bath. This is usually desirable towards or at the end of the dyeing since the structure sensitive dye may strike too fast and cause an unlevel dyeing if the pH or temperature is too low initially. Decreasing the pH can be done by metering a suitable acid solution such as acetic acid into the bath after the dye addition period or by using an acid donor such as the acid donor sold by Sandoz Chemical Co. under the trademark SANDACID V® which hydrolyzes and lowers pH in a gradual, controlled manner.

In a preferred process of the invention, at least about 33% of the dye is added to the bath when the solvent and the article are at least equal to the dyeing transition temperature, i.e., during the rapid dye uptake phase. Most preferably, at least about 50% of the dye is added during the rapid dye uptake phase. As will become more apparent in the examples which follow, increasing dye yield benefits will be obtained with increases in the amount of dye added during the rapid dye uptake phase. However, it may be desirable to forgo some of the dye yield increase to take advantage of decreased cycle time which may be obtained by adding at least some of the dye into the bath before it is up to the dyeing transition temperature.

Stirring of the bath during the dye addition period and the rapid dye uptake phase is done to mix the dye concentrate with the solvent in the bath to form a dilute dye solution and to provide a flow of the dilute dye solution relative to the article to cause the dye to be transported to the article. The term "stirring" is intended to include any means of mixing and imparting relative motion between the article and the solvent in the dyeing bath. The relative motion between the article and the solvent can be imparted by circulating the solvent in the dye bath, moving the article in the solvent, or both moving the article and circulating the liquid. In the preferred process employing a jet-dyeing apparatus, both the article is moved and the bath liquid is circulated by action of circulating liquid with the fabric circulation being usually assisted by a rotating reel usually provided in such equipment.

The stirring also provides, on the average, essentially uniform dye transport of the anionic dye to the article during the dye addition period and rapid dye uptake phase so that a dyeing results which is sufficiently visually level to be useful for the intended purpose. Typically, a visually level fabric has shade variations across the fabric which are less than about 5%. Thus, during a process in which there are a number of repetitive cycles as in the preferred form of the invention in a jet dyer where the fabric rope cycles numerous times through the jet nozzle, the dye transport to the fabric may not be uniform in any one machine cycle. However, the additive effect of dye transport during all of the cycles is such that a level dyeing results since dye transport "on the average" is essentially uniform. As will become more apparent hereinafter, it may be desirable to increase the turnover rate, limit the dye addition rate, or both to decrease the percentage of total dye added per cycle and thereby increase uniformity due to the greater averaging effect obtained. To facilitate control over the process and to enable a process to be repeated, it is preferable for stirring to be performed constantly and at a constant rate.

In accordance with the invention, the dye addition rate is adjusted to be the primary control over the rate of dye uptake by the article at least while the solvent and the article are at or above the dyeing transition temperature. The type of adjustment of the dye addition rate necessary to accomplish this may be better understood by reference to Equation I which takes into account factors impacting the dyeing process:

$$L = \frac{Ds}{K \cdot Df} \times \frac{r}{\delta} \qquad \text{I}$$

In Equation I, Ds is the diffusion coefficient of the dye in solution, Df is the diffusion coefficient of the dye in the fiber, K is the equilibrium distribution coefficient for the dye-fiber system, r is the radius of the fiber, and δ is thickness of the diffusional boundary layer. In a process in accordance with the invention, it has been discovered that adjusting the rate of dye addition into the bath and coordinating the rate with other conditions in the bath so that the rate of dye addition is the primary control over the rate of dye uptake provides low values for L in Equation I. It has further been discovered that the maximum benefits of the invention result when L is very low, preferably approaching zero.

To cause the rate of dye addition to be the primary control over the rate of dye uptake and thereby provide low L values, the rate of dye addition is limited so that the fibrous article, which is readily capable of accepting dye since it is above the dyeing transition temperature, is capable of accepting more dye than is supplied to it. Under these conditions, the concentration of dye in the bath is very much lower than in a conventional process and the influence of the diffusion coefficient in the fiber, Df, is therefore substantially less significant than in a conventional process. Also, the value for Ds/(K·Df) will be smaller than in a conventional process and will lead to lower L values, primarily because the value for K will increase as the concentration of dye in the dye bath decreases. This effect is particularly pronounced in the preferred form of the invention where dyes are used and/or conditions established so that the dyes transfer less than about 10%. In such cases, the value for K is very high and is further increased by the limited concentration of dye in the bath.

Preferably, the dye addition rate is adjusted so that the concentration of dye in the solvent at the location of lowest concentration in the dyer is not greater than about 100 times the final equilibrium concentration for any substantial period of time while the solvent and the article are at a temperature at least equal to the dyeing transition temperature. In a process in accordance with the invention in which the dye is added to the bath before the dyeing transition temperature is reached, a high concentration of dye may temporarily be present in the bath while the bath is at or above the dyeing transition temperature. This time period with high concentration should not be a substantial period of time, i.e., should not be greater than about 10% of the time when the bath is at or above the dyeing transition temperature. For the maximum benefits to be obtained when conditions are used or dyes are selected so that the dyes transfer less than about 10%, it is preferred for the concentration to not be greater than 100 times the final equilibrium concentration for any period of time while the bath is at or above the dyeing transition temperature. Most preferably, the dye addition rate is adjusted so that the concentration does not exceed about 50 times the final equilibrium concentration.

The "final equilibrium concentration" is the concentration of dye in the dyebath for a particular % dye on the article under the process conditions at which there is essentially no further increase in the depth of dyeing without the addition of new dye. The final equilibrium concentration can be determined with reasonable certainty in the process itself by extrapolation from the concentration measured in the dye bath at the end of the dyeing process. Usually, when the dyeing process is complete in a commercial dyeing, the dye will have been sufficiently exhausted (and will have a uniform concentration in the bath) so that the final concentration before the bath is dropped can be assigned as the final equilibrium concentration. During the dyeing process, the location of lowest concentration in the dyer is usually just ahead of where dye is introduced into the bath. For example, in a process where the solvent is circulated using a pump and the dye is added ahead of the pump, the concentration of the dye in the solvent just ahead of where the dye is added will be the lowest concentration. In commercial jet dyers, existing sampling ports which are remote from the jet are also suitable for measuring this concentration since the sample obtained at such ports is essentially equivalent to the concentration just ahead of where dye is introduced into the bath.

In contrast, in a conventional process for dyeing nylon, the dye in the bath is initially on the order of 300–500 or more times the equilibrium concentration and remains in this range for a significant time until it is gradually decreased as the temperature is slowly increased to cause the dyeing to progress. If concentrations were to equal the concentrations used in conventional dyeings for a substantial period of time while the fiber contained little dye and was well above the dyeing transition temperature, a visually un-level dyeing likely would result, particularly when conditions are used or dyes are selected so that the dyes transfer less than about 10%.

To more fully realize the decrease in dye cycle times which are achievable in accordance with the present invention, the rate of dye addition is also preferably adjusted so that the concentration of dye in the solvent, as measured at the location of lowest concentration in the bath, is at least about 2.5 times the final equilibrium concentration for a sustained period of time while the solvent and the article are at a temperature at least equal to the dyeing transition temperature. Preferably, the sustained period of time comprises at least about 10% of the time while the solvent and the article are at a temperature at least equal to the dyeing transition temperature. Preferably, the concentration in the bath at the location of lowest concentration will be at least about 3.5 times the equilibrium concentration.

In commercial processes employing a number of repetitive machine cycles, e.g., turnovers of the rope in a jet or beck dyer or circulation of the bath in a beam dyer, it is preferable to adjust the rate of dye addition so that an amount of dye between about 0.5% and about 7% of the total dye is added in a machine cycle to achieve, on the average, essentially uniform dye transport and a visually level dyeing in accordance with the invention. Most preferably, an amount of dye between about 0.5% and about 3% is added during a machine cycle. Using laboratory jet and beck dyeing equipment, percentages of total dye per cycle are typically lower since laboratory equipment usually has a high turnover rate which would not be practical for use in large commercial dyeing equipment although excellent results are obtained.

Rates of dye addition based on the fabric weight in commercial jet and beck dyers are usually on the order of about 0.0005 to 0.5% dye/minute. The rates at the lower end of the range are useful for low percent dye-on-fiber dyeings with extremely high affinity dyes to provide a sufficient number of machine cycles for adequate averaging to provide essentially uniform dye transport.

Using the preferred process of the invention in which conditions are used so that the dyes transfer less than 10% in the same equipment used for conventional polyamide dyeings, articles containing dyed polyamide fiber can be produced with a higher relative dye strength for the same relative dye content, i.e., to have a higher relative dye yield, than can be obtained using conventional processes. Depending on the type of dye being used, the temperature and pH conditions in the dyebath can be used to adjust the relative dye yields obtained for a process of the invention in the same type of equipment under the same conditions. For example, with most anionic dyes, decreasing the pH will provide increases in relative dye yields. For dyes which level under conventional conditions, it may be desirable to employ lower temperatures which has the primary effect of decreasing transfer. With increased temperatures above the dye transition temperature, relative dye yields provided by many structure sensitive dyes may increase. However, in general, conditions which produce the maximum benefits in terms of dye yield with structure sensitive dyes may make it more difficult to obtain a visually level dyeing. Accordingly, it may be necessary to select conditions which provide a compromise between relative dye yield increases and still provide a level dyeing without extraordinary care.

The preferred process of the invention using dyes under conditions such that the transfer is less than 10% is capable of minimizing the sensitivity to structural differences in the fibers which can lead to non-uniform dyeing. Provided that the transport of the dye to the article is, on the average, essentially uniform, a visually level dyeing will result which can cover streaks in a fabric due to structural differences in the yarns and produce dyed fabric with a higher uniformity rating than is produced using a conventional process.

It is also possible to adjust the results of the invention by including dyeing auxiliaries in the solvent in the dye bath or including them in the dye concentrate. In general, auxiliaries which decrease the strike rate of the dye will decrease the relative dye yield obtained and the dyeing will be more like a conventional dyeing. In addition, where the dye is added into the bath before the bath has reached its dyeing transition temperature, the dye which is absorbed by the fiber before the dyeing transition temperature is reached will impart some conventional dyeing characteristics to the fiber in the article.

For setting up a commercial process in a jet dyer in accordance with the invention, it is advantageous for the process to be run first in laboratory scale equipment corresponding generally to the chosen process conditions. In the laboratory scale process, a dye addition rate can thereby be determined in advance or a rate based on past experience for the same or similar dyeings can be confirmed. Due to smaller ratios of the weight of the bath to the weight of the goods and particularly the lower turnover rates in larger scale dyers compared to typical laboratory dyers, the dye addition rate or conditions used may have to be further modified for successful larger scale dyeings.

In the preferred form of the invention, it is usually only necessary to carefully control the process during the rapid dye uptake phase and, at most other times during the process, temperature and other bath conditions need not be as carefully controlled. For example, elevating the bath to the desired temperature can be done quickly and pH adjustment prior to dye addition can be done expeditiously and without the degree of care required in the conventional process for dyeing nylon. This is particularly advantageous since, with only one critical stage and when constant temperature and pH are employed, the procedure will be easily reproducible and it will be possible to efficiently make repetitive dyeings of the same fabric. Moreover, in the event that it is discovered early in a dyeing process that the conditions in the bath are not as desired, the dye addition can be stopped and the desired conditions established before the dyeing is resumed.

After the dyeing is complete, the dyeing bath is cooled, typically to below about 175° F. (79.4° C.) and dropped. The article can be rinsed, dried and subsequently used in a conventional manner.

Figure 4:
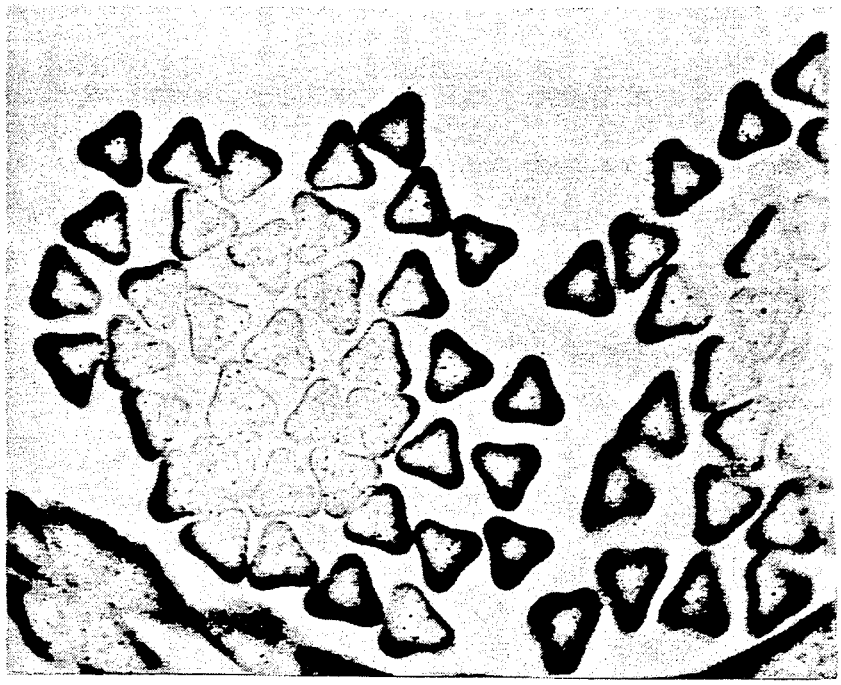
FIG. 4 is a cross-sectional photomicrograph at 400X of a yarn in a preferred dyed fabric in accordance with the invention (Example 8—Part B)

Referring now to FIG. 4 showing a cross-sectional photomicrograph at 400X of a preferred dyed fabric in accordance with the invention (Example 8—Part B), it is seen that the yarn filaments adjacent to the outside surfaces of the 66 nylon continuous filament yarns contain more dye than filaments in the interior of the yarn. In the yarn shown in FIG. 4, the dye is concentrated sufficiently in the outer filaments that some of the interior filaments appear to have little or no dye. In addition, filaments are asymmetrically ring-dyed, i.e., the filaments are dyed with more dye being present adjacent to the surface of the filaments than in the interior but the ring-dying of at least some of the filaments is asymmetric, i.e., more dye being present on one side or the other. It will be understood that in continuous filament yarns, the same filaments may exhibit different dyeing effects along the length of the yarn since the filaments may be in different positions in the yarn bundle.

Figure 5:
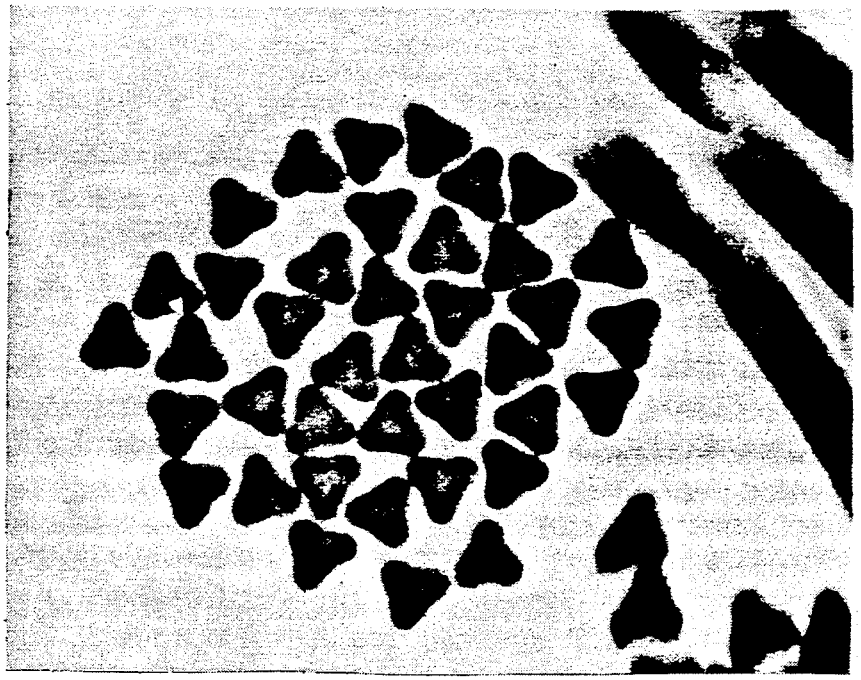
FIG. 5 is a cross-sectional photomicrograph at 400X of a yarn from the same type of fabric as FIG. 4 but dyed in a conventional manner (Example 8—Part A—Comparative)

FIG. 5 is a cross-sectional photomicrograph at the same magnification of a fabric dyed conventionally in the same apparatus (Example 8—Part A). It is apparent that the dye is distributed more evenly throughout the yarn bundle with little difference between surface and interior filaments. Little ring-dyeing has occurred and, to the extent that ring dyeing is visible, it appears to be symmetric.

Figure 6:
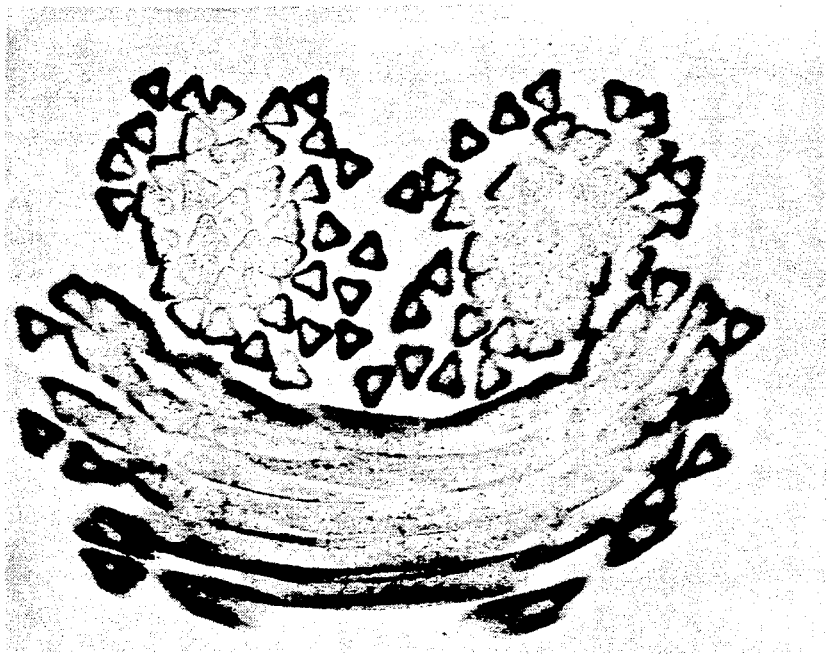
FIG. 6 is a photomicrograph as in FIG. 4 at 250X.
Figure 7:
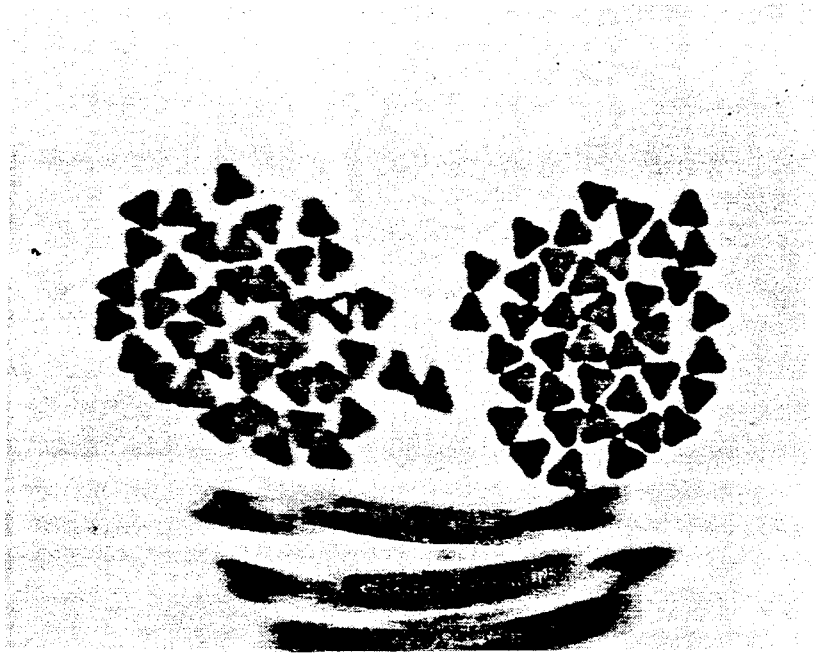
FIG. 7 is a photomicrograph as in FIG. 5 at 250X.
Figure 8:
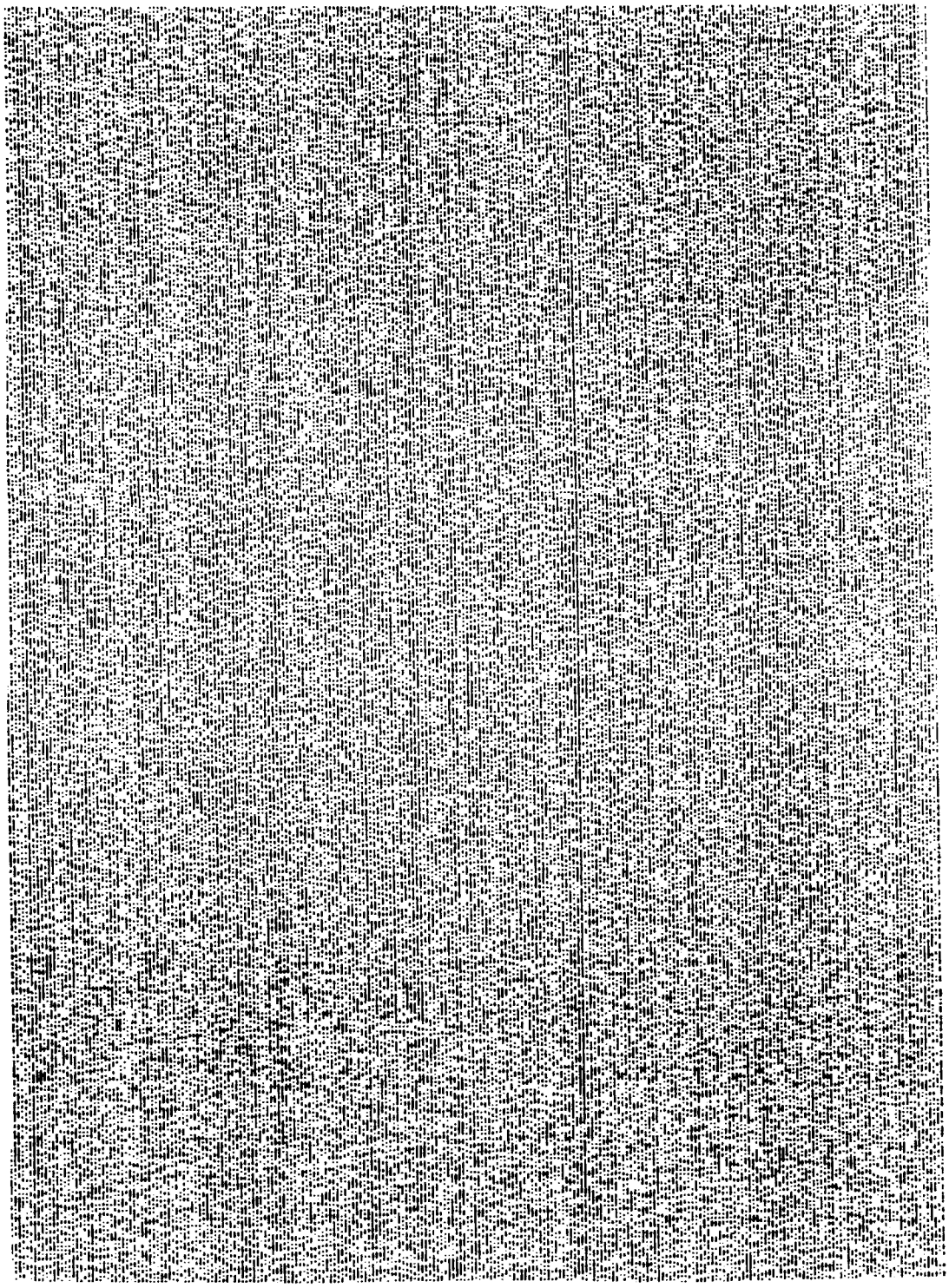
FIGS. 8–17 are a series of computer-generated standards with simulated fabric streaks used as a basis for fabric uniformity ratings in this application (Example 6).
Figure 9:
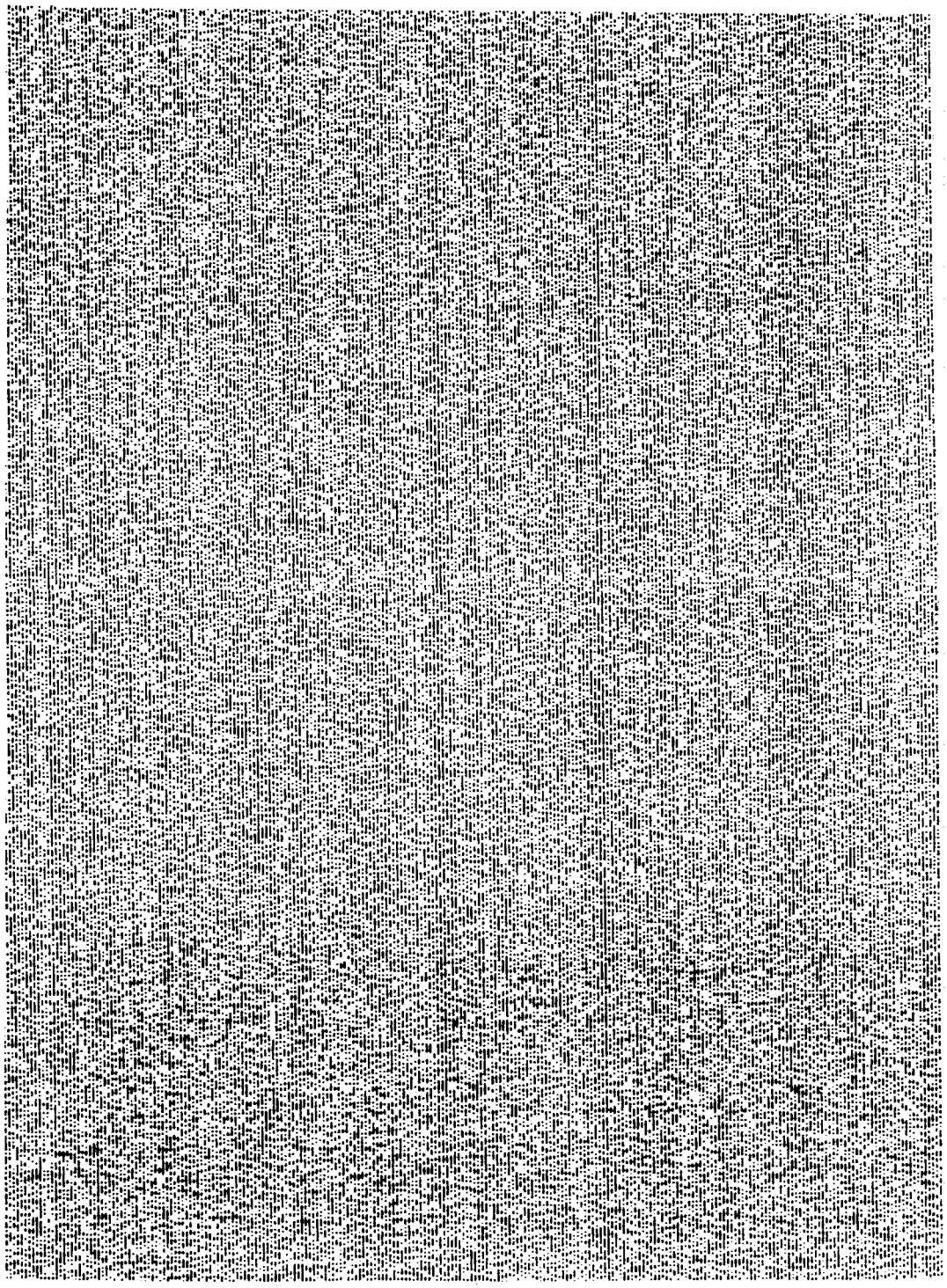
Figure 10:
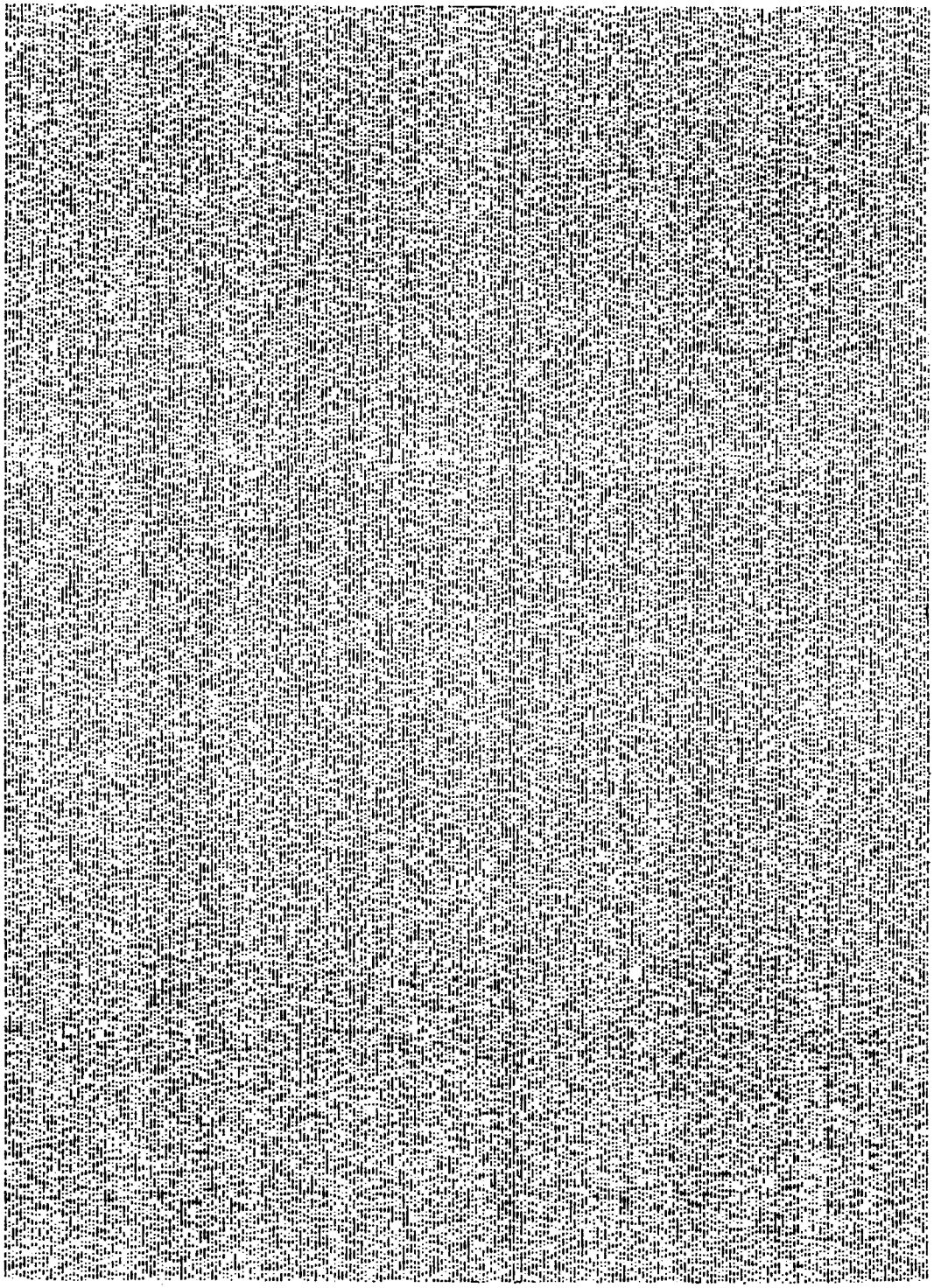
Figure 11:
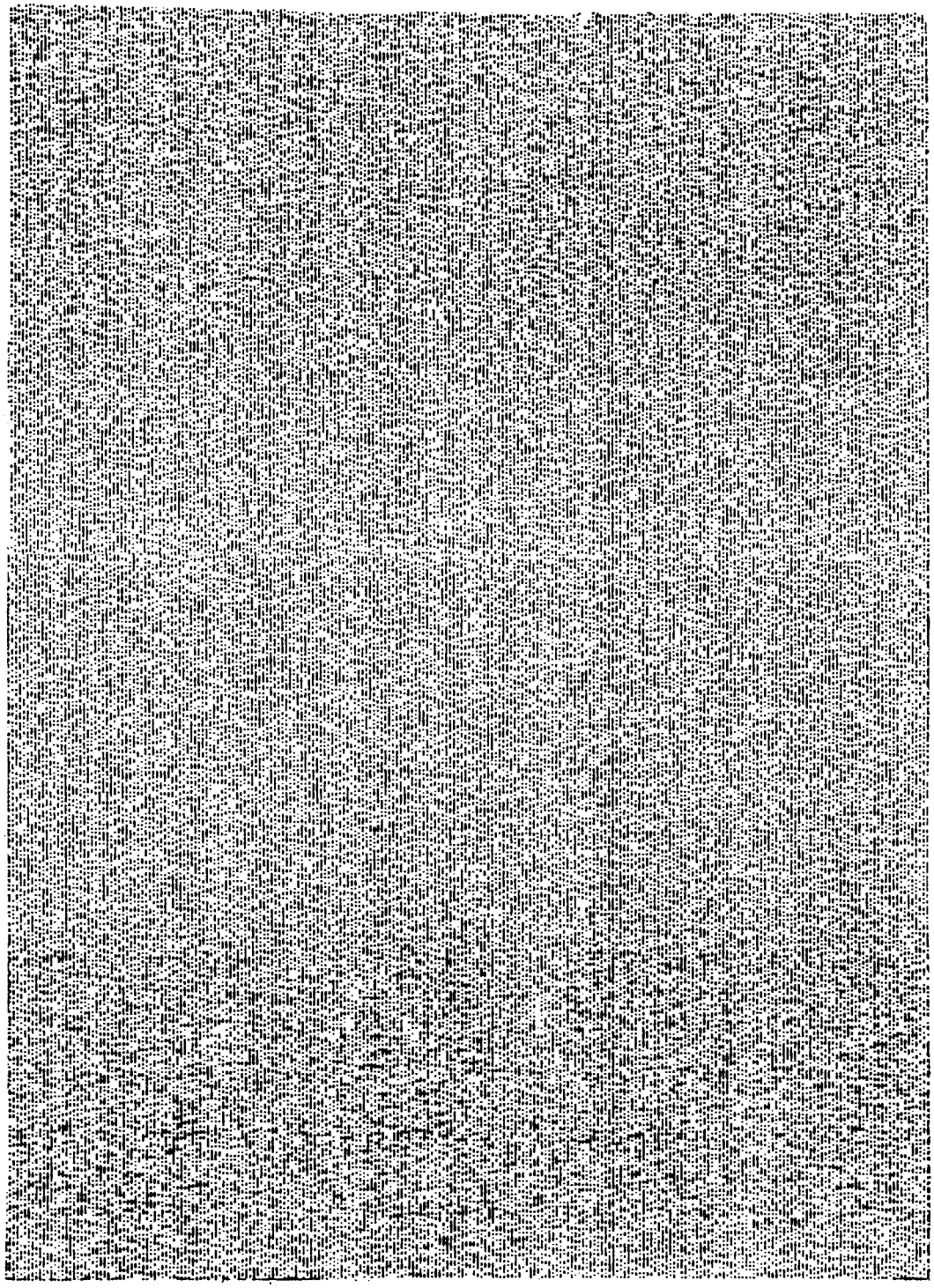
Figure 12:
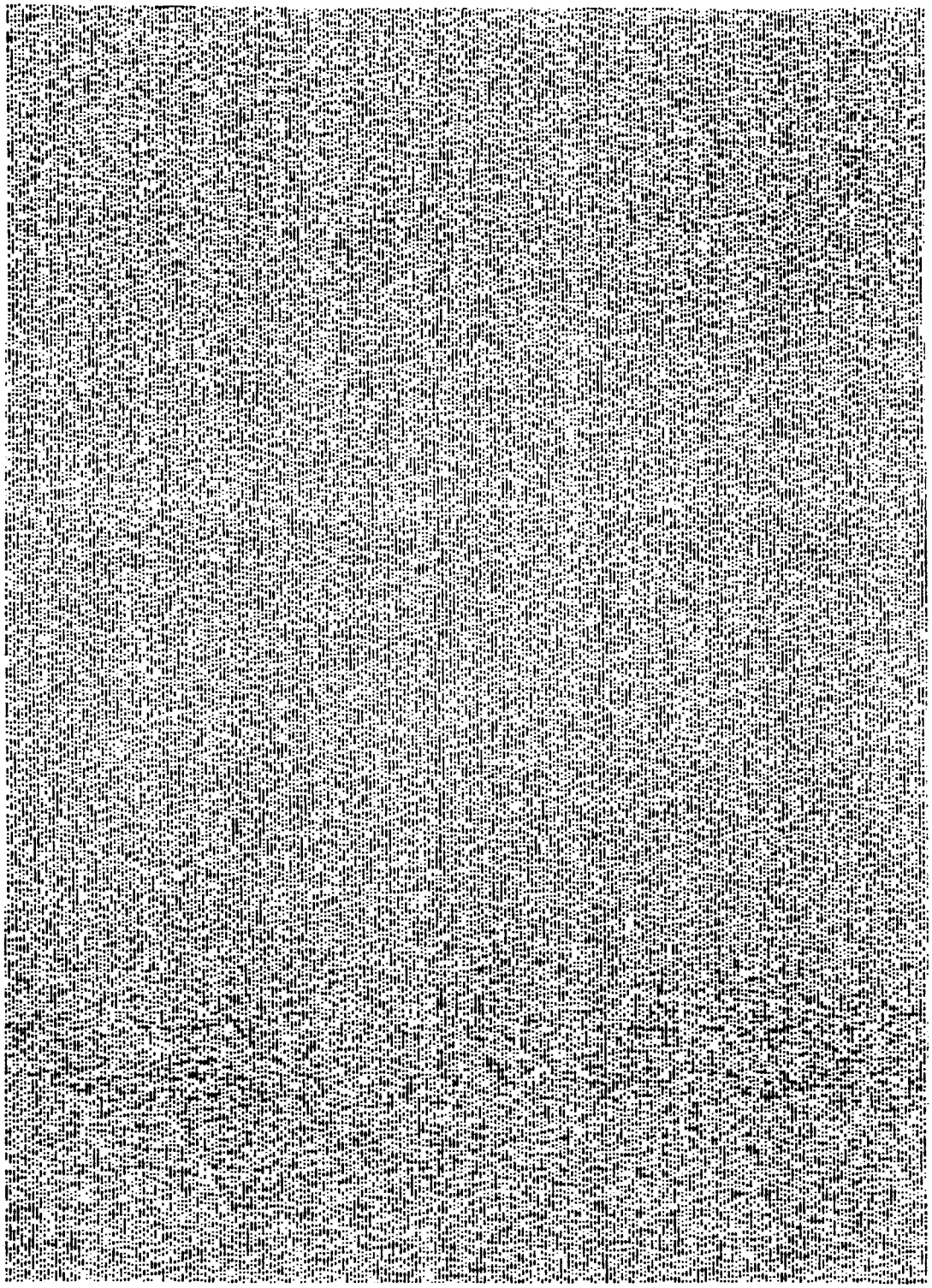
Figure 13:
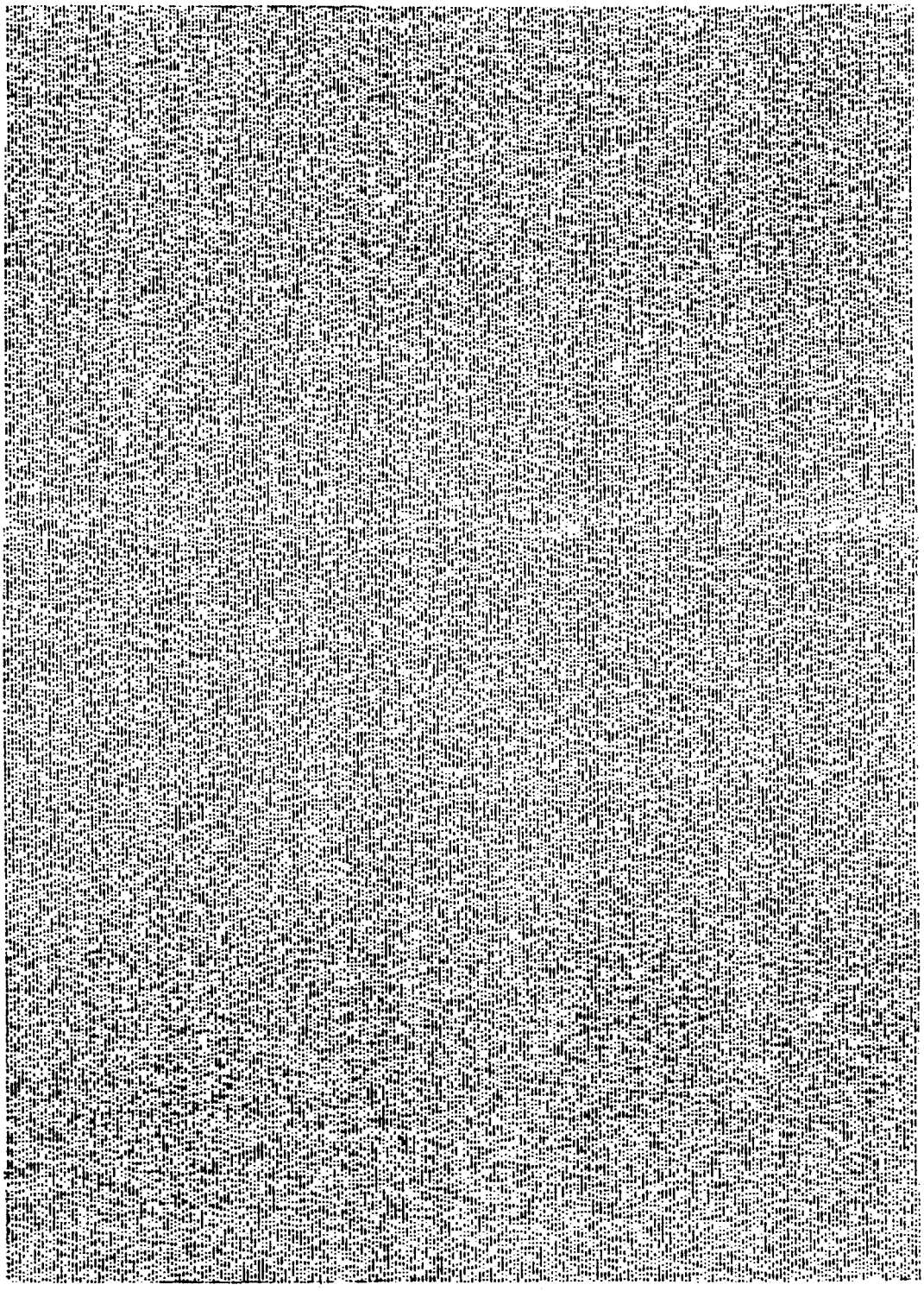
Figure 14:
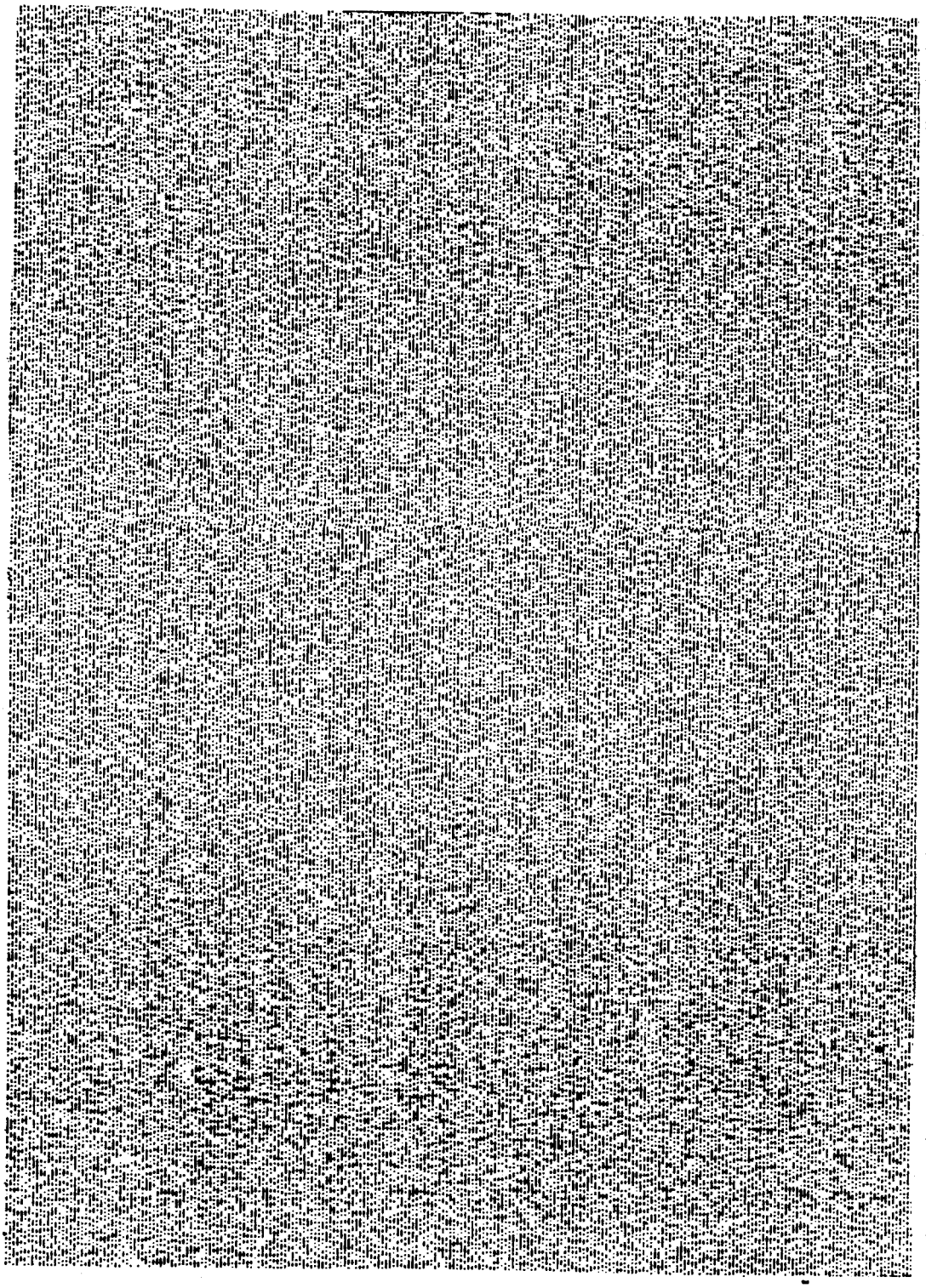
Figure 15:
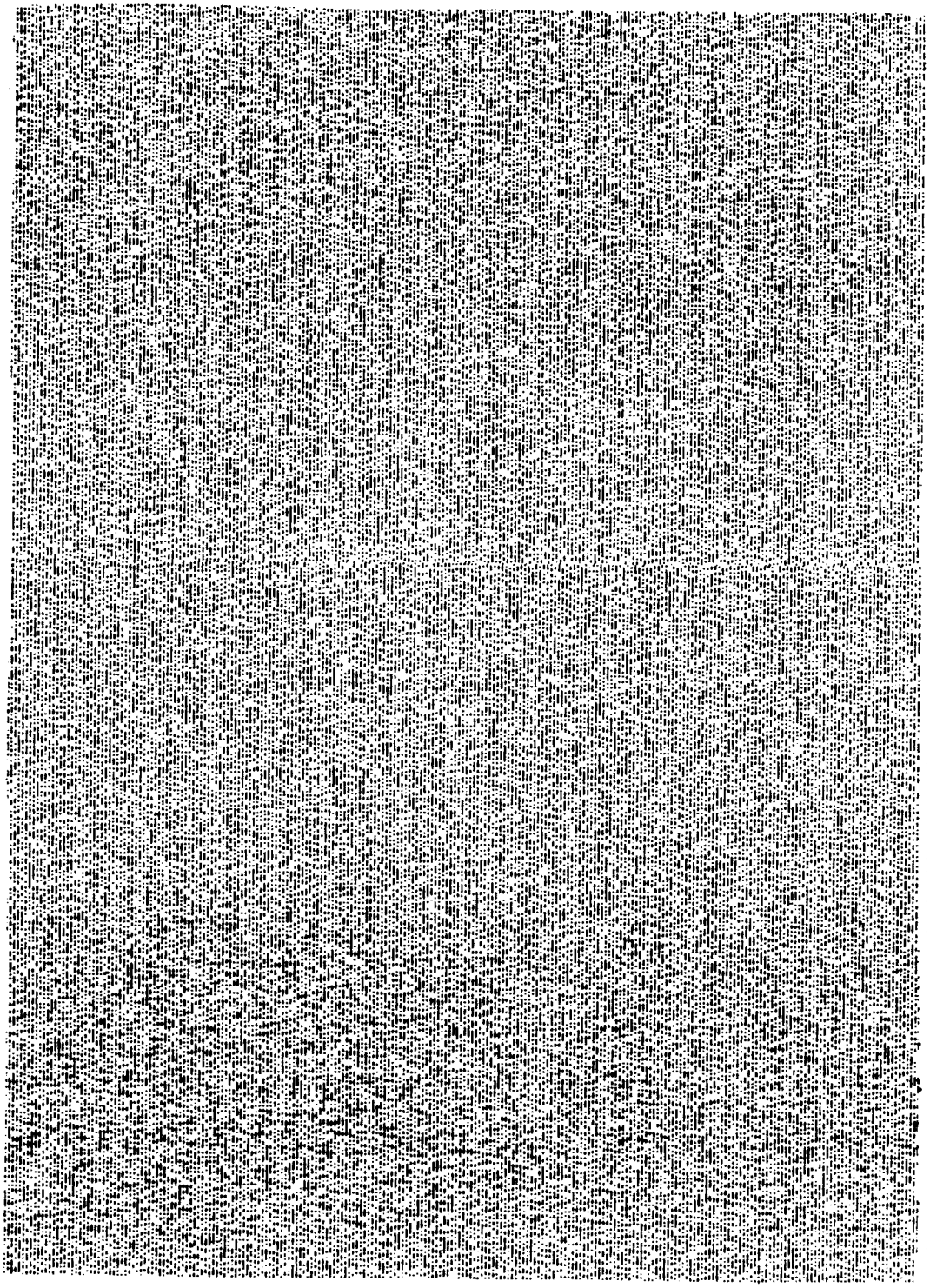
Figure 16:
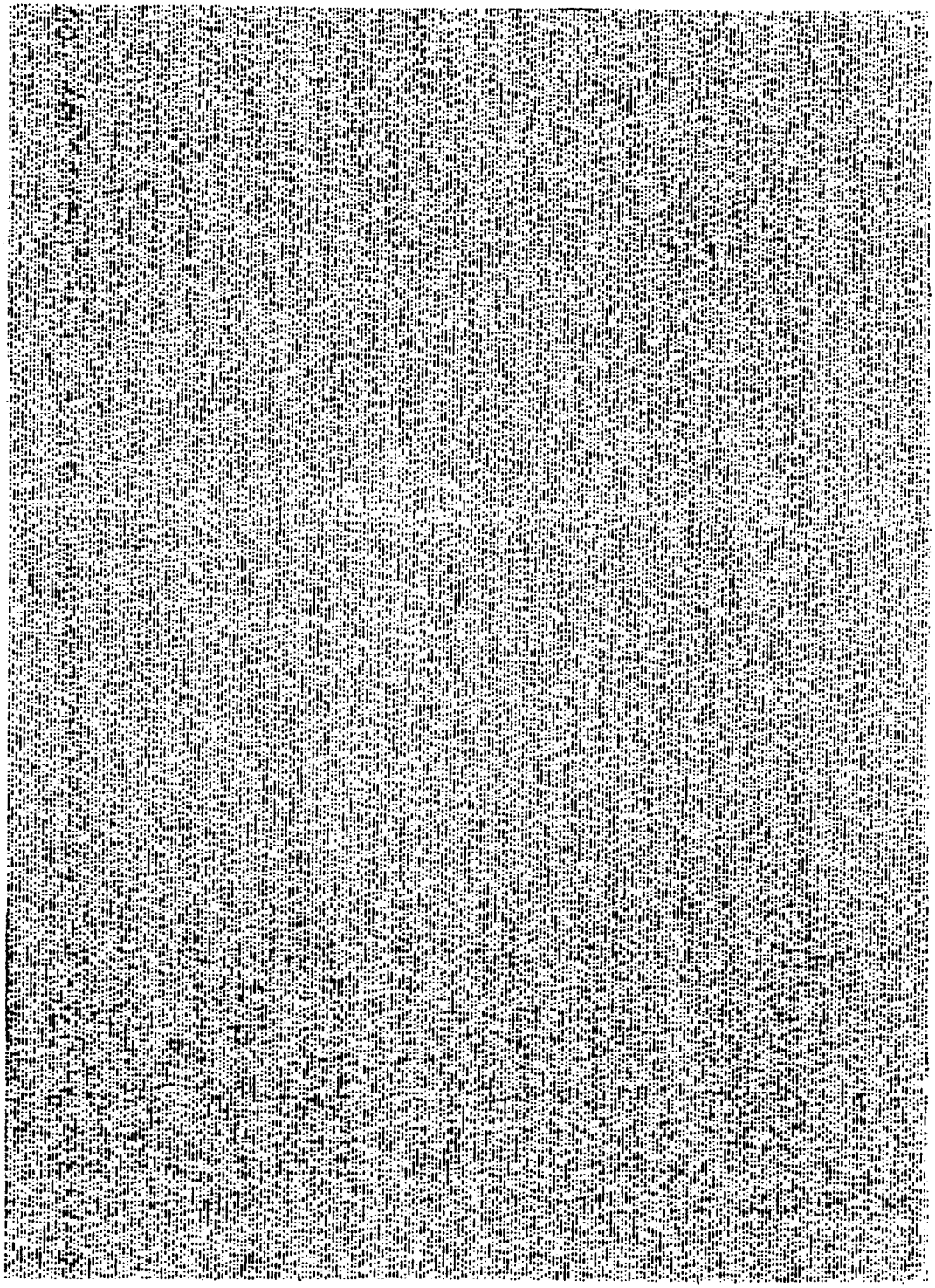
Figure 17:
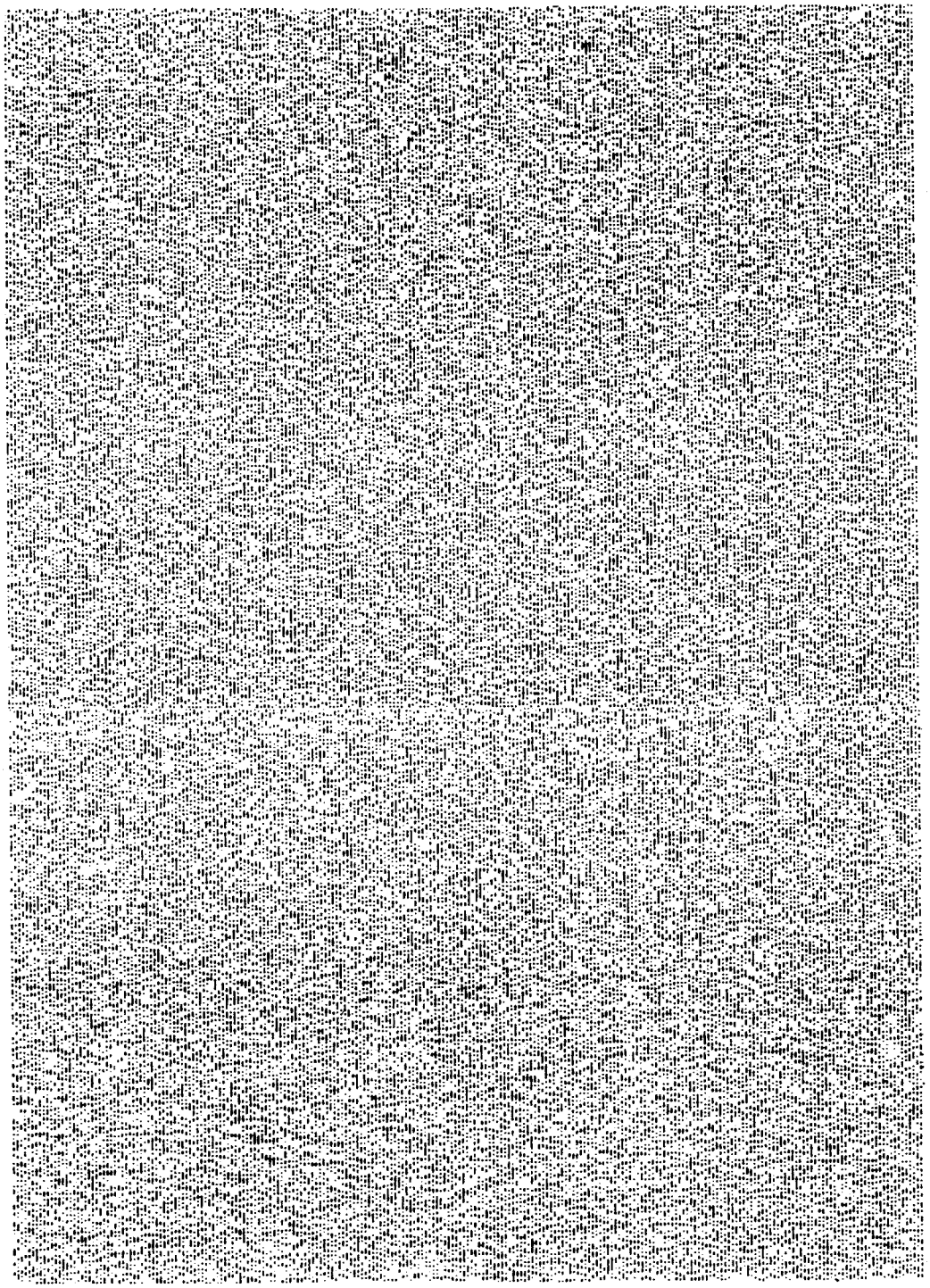

As shown in FIG. 6 which is the same fabric of FIG. 4 at 250X, fabrics in accordance with the invention also have more dye on yarns adjacent to the surfaces of the fabric than in the interior of the fabric. FIG. 7 shows a conventionally dyed fabric (same as FIG. 5 at 250X) in which the dye is distributed generally evenly throughout the fabric.

Despite the asymmetric dyeing of the yarns and filaments, fabrics of the invention are visually level and are highly uniform. Moreover, the uniformity is often better than fabrics dyed conventionally, particularly with structure sensitive dyes. Often, streaks which appear in a fabric dyed conventionally due to non-uniformity in the yarn can be reduced or substantially eliminated in a dyed fabric in accordance with the invention. In the most preferred dyed fabrics in accordance with the invention, the fabrics are essentially free of end-to-end dye non-uniformities. In addition, the fabrics are equivalent to conventional fabrics in lightfastness, washfastness and in abrasion tests such as the Stoll abrasion test.

Although the invention is applicable to other types of fabrics such as non-wovens and tufted fabrics used for carpeting, preferred fabrics in accordance with the invention are selected from the class consisting of knitted and woven fabrics, most preferably those made using continuous filament yarns since dyed fabrics of this type with high uniformity ratings are often difficult to achieve. In addition, the fabric of the invention preferably contains at least one structure sensitive anionic dye.

The invention is applicable to other ionically-dyeable polyamides with other ionic dyes such as the dyeing of cationically-dyeable polyamides with cationic dyes. For example, polyamides modified with 5-sulpho-isophthalate can be dyed with cationic dyes such as SEVRON Blue 5GMF (C.I Basic Blue 3) using the process of the invention.

TEST METHODS

The Dye Transition Temperature is determined for a fiber/dye combination as follows:

A sample of the article is prescoured in a bath containing 800 g water/g of sample with 0.5 g/l of tetrasodiumpyrophosphate and 0.5 g/l of MERPOL HCS® (a liquid non-ionic detergent sold by E. I. du Pont de Nemours & Company). The bath temperature is raised at a rate of about 3° C./min. until the bath temperature is 60° C. The temperature is held for 15 minutes at 60° C., then the fiber is rinsed. (Note that the prescour temperature must not exceed the dye transition temperature of the fiber. If the dye transition temperature appears to be close to the prescour temperature, the procedure should be repeated at a lower prescour temperature.) The bath (without the article) with a similar quantity of water is adjusted to 30° C. and 1% (based on the weight of the article) of the dye to be used and 5 g/l of monobasic sodium phosphate are added. (If more than one dye is to be used in the dyeing process, the dye believed to have the highest Dye Transition Temperature should be used to determine Dye Transition Temperature. Usually, this dye will also be the most structure sensitive.) The pH is adjusted to 5.0 using monobasic sodium phosphate and acetic acid. The article is added and the bath temperature is increased to 95° C. at a rate of 3° C./min.

With every 5° C. rise in bath temperature a dye liquor sample of ~25 ml is taken from the dye bath. The samples are cooled to room temperature and the absorbance of each sample at a wavelength known to be useful for monitoring the dye is measured on a spectrophotometer such as a Perkin-Elmer C552-000 UV-visible spectrophotometer (Perkin-Elmer Instruments, Norwalk, Conn. 06856) using a water reference. The % dye exhaust is calculated and plotted with respect to dyebath temperature. The temperature at 15% exhaust is the dye transition temperature.

% Transfer can be determined using the AATCC Test Method 159-1989 (AATCC Technical Manual/1991, p. 285-286) except with the mock dyebath being at the pH and temperature of the actual process under consideration and a 30 minute time period is used. Percent transfer is calculated in this method by measuring the relative dye strength of the original dyed sample before (control, 100% relative dye strength) and after the transfer procedure. The difference is the % transfer.

Relative Dye Strength is a relative measure of the strength of dye in a fabric determined photometrically for a series of fabrics dyed with the same dye with the sample dyed by the comparative or control procedure being arbitrarily designated as having 100% relative dye strength.

Relative dye strength for a fabric sample is measured at the wavelength of minimum reflectance using a MACBETH COLOR EYE 1500 PLUS SYSTEM Spectrophotometer, sold by Macbeth Division of Kollmorgen Instrument Corp. of Newburg, N.Y. A scan from 750 to 350 nm can be performed to determine the wavelength of minimum reflectance for the dye. All subsequent samples in a series with the same dye are then measured at the same wavelength. For example, the wavelength of minimum reflectance for C.I. Acid Blue 122 is 640 nm.

The sample produced by the comparative or control procedure is designated the control and assigned a relative dye strength of 100%. The remaining samples are then scaled in relative dye strength by the following:

$$\text{Rel. Dye Strength (\%)} = \frac{K/S \text{ sample}}{K/S \text{ control}} \times 100,$$

and $$K/S = \frac{(1-R)^2}{2R}$$

where: R = reflectance.

Relative Dye Content is a relative measure of dye content determined photometrically for a series of fabrics dyed with the same dye with the sample dyed by the comparative or control procedure being arbitrarily designated as having a 100% relative dye content.

The relative dye content is determined in the following way. First, a sample of the article is cut into small segments and about 0.1 gram is weighed to ±0.1 mg accuracy. Typically, a test series of samples of dyed articles is weighed to each have very nearly the same weights. The samples are dissolved in 30 ml of formic acid at ambient temperature. After sample dissolution is complete, centrifugation for 20 minutes is effective for removing titanium dioxide delusterant when present.

A Perkin-Elmer C552-000 UV-visible spectrophotometer (Perkin-Elmer Instruments, Norwalk, Conn. 06856) is used to record the absorbance of the samples. A scan from 750 to 350 nm is performed and the largest peaks are chosen as analytical wavelengths for the dye tested. All subsequent samples in a series with the same dye are then measured at these wavelengths. Typically, sample sizes around 0.1 gram give absorbance readings in the range of 0.3 AU to 0.8 AU for the dye levels obtained.

A corrected absorbance is calculated for each wavelength measured on every sample in the series. The corrected absorbance is:

$$A \text{ (corrected)} = (S \times 0.1 \text{ gram})/W$$

where: S = absorbance at a given wavelength; and W = weight of sample in grams

The sample dyed by the comparative or control procedure is assigned a relative dye content of 100%. The remaining samples are then scaled in relative dye content by the following:

$$\text{Rel Dye Content (\%)} = (As \cdot 100)/A_1$$

where: $A_s$ = average absorbance of sample; and $A_1$ = average absorbance of the control sample.

This calculation is performed for every analytical wavelength chosen in a given dye series.

Yarn Cross-sectional Micrographs

Fabric swatches, or yarn bundles, are embedded in "Marglas", or a similar epoxy resin designed for microtomy. Approximately ten micron thick sections are made using a steel microtome knife. These sections are cut in a direction which will enable examining cross sections of fibers at various depths into the fabric. The sections are placed on a microscope slide and immersed in a refractive index liquid which matches, and therefore renders invisible, the epoxy embedding material. Magnifications of 100x to 500x, using objective lenses of 10x to 40x are convenient and useful for assessing distributions of dye within the filaments, within the yarn bundles and through the fabric thickness.

Relative Dye Yield is defined as the ratio of the Relative Dye Strength to the Relative Dye Content:

$$\text{Rel. Dye Yield} = \frac{\text{Relative Dye Strength}}{\text{Relative Dye Content}}$$

Dyebath Concentrations are measured using a Perkin-Elmer Lambda 2 Spectrophotometer (Perkin-Elmer Instruments, Norwalk, Conn. 06856) using wavelengths with high absorbance for the dye or dyes being measured.

Fabric Uniformity Ratings are determined by the following procedure:

Fabric swatches are laid on a large table in a room with diffuse fluorescent lighting. The fabric is rated by a panel of experts on a scale from 1 to 10 using the computerized simulation of fabric streaks now being considered for a standard by the AATCC (Committee RA97, Assessment of Barre,). Copies of the computerized simulations are attached as FIGS. 8-17.

The invention is illustrated in the following examples which are not intended to be limiting. Percentages are by weight unless otherwise indicated.

EXAMPLE 1

50 grams of a warp knit fabric (10 in × 72 in) from a 45 denier, trilobal 4.5 dpf 66 nylon fiber are sewn into a tube widthwise. The fabric is then introduced into a Werner-Mathis Laboratory Jet Dyeing Apparatus, Type JF, sold by Werner-Mathis, U.S.A., of Concord, N.C. The fabric is put through the jet nozzle then sewn at the ends to form an endless tube. The see-thru door is closed and then the fabric is scoured under conventional conditions at 160° F. (71.1° C.) for 15 minutes using 0.1 g/l of MERPOL LFH® (a liquid nonionic detergent sold by E. I. du Pont de Nemours & Company) and 0.1 g/l of ammonium hydroxide. The fabric is overflow rinsed to remove all scouring agents and then the bath is dropped.

The dyeing bath is then set with 2500 ml of distilled water at a 50:1 liquor ratio (weight of bath to weight of fabric) at 80° F. (26.7° C.) and then the pH is adjusted to 5.0 with monosodium phosphate (MSP) and phosphoric acid. Under these conditions the fabric is fully flooded by the dyeing bath. The fabric is set into rapid motion by pumping the dyeing bath thru the jet nozzle. The temperature of the dyeing bath is then raised rapidly by 5° F./min. (2.8° C./min.) or greater to the dyeing temperature. In this example, the dyeing temperature is held nearly constant at about 200° F. (93.3° C.) during the dye addition period as the dye is added as described below. (The rapid dye uptake phase of this example begins with the addition of dye during the dye uptake phase, i.e., 100% of the dye is added during the rapid dye uptake phase.)

Separately 0.5 g of Anthraquinone Milling Blue BL (C.I. Acid Blue 122) dye is dissolved in 200 ml of distilled water to form a dye concentrate. The amount of dye used is calculated to provide 1% dye-on-fiber assuming complete exhaustion of the dye. Using a precision (~1% accuracy) MANOSTAT COMPULAB liquid metering pump sold by Manostat Corporation of New York, N.Y., the separately prepared dye solution is metered under the surface of the dyeing bath away from the moving fabric at the rate of 5 ml/minute which is equivalent to 0.025% dye/minute based on the weight of fabric. The percentage of total dye added per fabric turnover (machine cycle) is 0.08%. Under these conditions there is never any visible build-up of dye in the dyeing bath during the period of dye addition which is complete in 40 minutes. The dyeing bath is then cooled at 5° F./min. (2.8° C./min.) to 170° F. (76.7° C.), then the fabric is overflow rinsed, removed from the dyeing machine, then air dried.

The result obtained is a level blue dyeing on the nylon warp knit and a colorless dyeing bath.

EXAMPLE 2

The amount and type of fabric and the dyeing equipment and procedure described in Example 1 are also used in this Example with the following dyes dissolved in 200 ml of distilled water to form the dye concentrate:

0.247 g of C.I. Acid Yellow 184

0.008 g of Nylanthrene Pink BLRF*

*Crompton & Knowles Corp., P.O. Box 33188, Charlotte, N.C. 28233)

0.200 g of C.I. Direct Blue 86

This is calculated to provide 0.9% dye-on-fiber assuming complete exhaustion of the dye. The dyeing solution is metered at the rate of 5 ml/min. which is equivalent to 0.023% dye/minute based upon the weight of the fabric. The percentage of total dye added per fabric turnover (machine cycle) is 0.08%. Under these conditions there is a slight visible build up of dye at the end of the dye addition period which is completed in 40 minutes. The dyeing bath is cooled at 5° F./min. (2.8° C./min.) to 170° F. (76.7° C.) at which time the bath is colorless and appears to be exhausted. The fabric is overflow rinsed, removed from the dyeing machine, then air dried.

The result obtained is a level lime green dyeing on the nylon warp knit fabric and a colorless dyeing bath.

EXAMPLE 3

The amount and type of fabric and the dyeing equipment and procedure described in Example 1 are also used in this Example except that the dyeing bath is set at pH 4.0 with monosodium phosphate (MSP) and phosphoric acid and the dye used is 2.00 g of C.I Acid Black 107 dissolved in 400 ml of distilled water. This is calculated to provide 4.0% by weight of dye-on-fiber assuming complete exhaustion of the dye.

The dyeing solution is metered at the rate of 20 ml/minute which is equivalent to 0.2% dye/minute based on weight of fabric. The percentage of total dye added per fabric turnover (machine cycle) is 0.17%. Under these conditions there is never any visible build up of dye in dyeing bath during the dye addition period which is complete in 20 minutes. The dyeing bath is cooled at 5° F./min. (2.8° C./min.) to 170° F. (76.7° C.). The fabric is overflow rinsed removed, and then air dried.

The result obtained is a level black dyeing on the nylon warp knit fabric and a colorless dyeing bath.

EXAMPLE 4

The dyeing equipment described in Example 1 is used in this Example for dyeing a warp knit fabric from 80 weight % 40 denier trilobal 1.3 dpf 66 nylon fiber and 20 weight % 40 denier LYCRA ®) spandex (E. I. du Pont de Nemours and Company). In Part A, a conventional dyeing procedure is used. Parts B and C illustrate the process of the invention under different dyeing bath temperatures. Table 1 summarizes the results obtained.

PART A (Comparative)

50 grams of the fabric described above is scoured under conventional conditions at 160° F. (71.1° C.) for 15 minutes using 0.1 g/l of MERPOL LFH ® and 0.1 g/l of ammonium hydroxide. The fabric is overflow rinsed to remove all scouring agents then the bath is dropped. The dyeing bath is set with 2500 ml of distilled water at 80° F. (26.7° C.) then the pH is adjusted to 5.0 with MSP and phosphoric acid. The fabric is set into rapid motion by the action of the jet nozzle.

Separately 0.5 grams of C.I. Acid Blue 122 is dissolved in 200 ml of distilled water to provide 1% dye-on-fabric (1.25% on weight of nylon fiber) assuming complete exhaustion. The dye solution is then added to the dyeing bath. Under these conditions the fabric is fully flooded by the dyeing bath. The dyeing bath is raised at 2° F./min. (1.1° C./min.) to 200° F. (93.3° C.) then held at 200° F. (93.3° C.) for 30 minutes. The dyeing bath is cooled at 5° F./min (2.8° C.) to 170° F. (76.7° C.), the fabric is overflow rinsed, removed from the dyeing machine, then air dried.

The result is a level blue dyeing on the nylon/LYCRA ® spandex warp knit fabric and a completely colorless dyeing bath. The total cycle time is approximately 100 minutes. Relative dye strength is measured on the underlap side of the dried fabric and this fabric is designated as having 100% relative dye strength.

PART B

The amount and type of fabric, dyeing equipment and scouring conditions used in Part A are also used in this example.

In this example the dyeing bath is set with 2500 ml of distilled water at 80° F. (26.7° C.) then the pH is adjusted to 5.0 with MSP and phosphoric acid. Under these conditions the fabric is fully flooded by the dyeing bath. The fabric is set into rapid motion by pumping the dyeing bath thru the jet nozzle. The temperature of the dyeing bath is raised rapidly at about 5° F./min. (2.8° C./min.) to dyeing temperature. In this example the dyeing temperature is held nearly constant at 180° F. (82.2° C.) during the dye addition period.

Separately 0.5 gm of C.I. Acid Blue 122 is dissolved in 200 ml of distilled water. This is calculated to provide 1% dye-on-fabric (1.25% on weight of nylon fiber) assuming complete exhaustion. Using equipment described in Example 1, the separately prepared dye solution is metered into the dyeing bath at the rate of 5 ml/minute which is equivalent to 0.025% dye/minute based upon weight of fabric while maintaining the dyeing temperature. The percentage of total dye added per fabric turnover (machine cycle) is 0.08%. Under these conditions there is never any visible build-up of dye in the dyeing bath during the dye addition period which is completed in 40 minutes. The dyeing bath is cooled at 5° F./min. (2.8° C./min.) to 170° F. (76.7° C.), then the fabric is overflow rinsed, removed from the dyeing machine, then air dried.

The result obtained is a level blue dyeing on the nylon/LYCRA ® spandex warp knit and a colorless dyeing bath. The total cycle time is 66 minutes which is 33% less than in Part A. In addition, relative dye strength measured for the blue color of the fabric (640 nm) is 36% higher than the fabric resulting from Part A. Color of fabric is measured on underlap side.

PART C

The amount and type of fabric, dyeing equipment, and procedure described in Part B are also used in this example except the dyeing temperature is held nearly constant at 200° F. (93.3° C.) during the dye addition period while the dye is metered into the bath.

The result obtained is a level blue dyeing on the nylon/LYCRA ® spandex warp knit and a colorless dyeing bath. The total cycle time is 66 minutes which is 33% less than Part A. In addition, the relative dye strength measured for the blue color of the fabric (640 nm) is 65% higher than the fabric resulting from Part A. Color of fabric is measured on underlap side.

TABLE 1

| Part | Cycle time (Minutes) | Bath Temp. °F. | (°C.) | Relative Dye Yield (%) |
|---|---|---|---|---|
| A (Comparative) | 100 | 200 | (93.3)* | 100 |
| B | 66 | 180 | (82.2) | 136 |
| C | 66 | 200 | (93.3) | 165 |

*Maximum temperature

EXAMPLE 5

The dyeing equipment described in Example 1 is also used in this Example for dyeing a circular knit, tubular fabric (4½ in. tubular; 8½ in. open width × 62 in.) from a 40 denier, trilobal 3.08 dpf 66 nylon fiber with Anthraquinone Blue B (C.I. Acid Blue 45) used under conditions such that the dye transfers less than 10%. In Part A, a dyeing procedure is used in which all of the dye is present in the bath initially at low temperature and then the temperature is raised to complete the dyeing. Part B illustrates the process of the invention. The concentration of the dye in the bath is measured during the dyeings and Tables 2 and 3 list concentrations for Parts A and B, respectfully.

PART A (Comparative)

35 grams of the fabric described above is scoured and rinsed as in Example 1. The dyeing bath is then set as in Example 1 (70:1 liquor ratio, i.e., weight of bath to weight of fabric) at 80° F. (26.7° C.) and then the pH is adjusted to 4.5 with monosodium phosphate (MSP) and phosphoric acid. The fabric is set into rapid motion by the action of the jet nozzle.

Separately 0.175 grams of C.I. Acid Blue 45 is dissolved in 200 ml of distilled water to provide 0.5% dye-on-fabric assuming complete exhaustion. All of the dye solution is then added to the dyeing bath at 80° F. (26.7° C.). Under these conditions the fabric is fully flooded by the dyeing bath. The dyeing bath is raised at 2° F./min. (1.1° C./min.) to 140° F. (60° C.) then held at temperature for 30 minutes. Bath samples are taken at approximately 10° F. (5.6° C.) temperature increments from 80° F. (26.7° C.) to 140° F. (60° C.). During the hold period at 140° F. (60° C.) bath samples are taken at 5 minute intervals. Bath concentrations of C.I. Acid Blue 45 during this control procedure are shown in Table 2.

The fabric is overflow rinsed, removed from the dyeing machine, then air dried. The result is a level blue dyeing on the circular knit fabric and a colorless dyeing bath. Relative dye strength is measured on the face of the dried fabric and this fabric is designated as having 100% relative dye strength.

TABLE 2

| Sample | Temperature °F./(°C.) | Time After Reaching Concentration 140° F./60° C. (Minutes) | In Bath; Parts Per Million |
|---|---|---|---|
| 1 | 80 (26.7) | | 42 |
| 2 | 86 (30) | | 50 |
| 3 | 95 (35) | | 47 |
| 4 | 104 (40) | | 44 |
| 5 | 113 (45) | | 41 |
| 6 | 122 (50) | | 36 |
| 7 | 131 (55) | | 32 |
| 8 | 140 (60) | | 29 |
| 9 | | 5 | 16 |
| 10 | | 10 | 13 |
| 11 | | 15 | 7 |
| 12 | | 20 | 3 |
| 13 | | 25 | 2 |
| 14 | | 30 | 1 |

PART B

The amount and type of fabric, scouring conditions, dyeing equipment are repeated in this example of the invention.

In this example of the invention, the dyeing bath is set as in Part A. The fabric is set into rapid motion by pumping the dyeing bath thru the jet nozzle and the temperature of the dyeing bath is raised rapidly by 5° F./min. (2.8° C./min.). In this example, the dyeing temperature is held at 140° F. (60° C.) during the dye addition period.

Separately 0.175 g of Anthraquinone Blue B (C.I. Acid Blue 45) dye is dissolved in 100 ml of distilled water. This is calculated to provide 0.5% dye-on-fiber assuming complete exhaustion of the dye. Using the equipment described in Example 1, the separately prepared dye solution is metered under the surface of the dyeing bath, with the bath at 140° F. at the rate of 5 ml/minute, over a 20 minute dye addition period which is equivalent to 0.025% dye/minute based on the fabric weight. The percentage dye added per fabric turnover (machine cycle) is 0.17%. Samples of the dyeing bath are taken after 25 ml, 50 ml, 75 ml and 100 ml of dye are metered in. Bath samples are also taken 5, 10, 15, 20, 25 and 30 minutes after all the dye solution is metered in. The concentrations of dye in these samples are measured and the results are reported in Table 3. Then, the fabric is overflow rinsed, removed from the dyeing machine, and air dried.

The result obtained is a level blue dyeing on the nylon circular knit and a colorless dyeing bath. An increase in relative dye yield of 12 to 15% is measured on the face of the dried fabric with respect to comparative dyeing described in Part A above.

TABLE 3

| Bath Sample | Ml of Dye Concentrate Added | Time After All Dye Added (Minutes) | Concentration In Bath; Parts Per Million |
|---|---|---|---|
| 1 | 25 | | 0.40 |
| 2 | 50 | | 1.08 |
| 3 | 75 | | 1.6 |
| 4 | 100 | | 2.1 |
| 5 | 125 | | 1.9 |
| 6 | 150 | | 3.1 |
| 7 | 175 | | 4.3 |
| 8 | 200 | | 4.1 |
| 9 | | 5 | 2.9 |
| 10 | | 10 | 1.6 |
| 11 | | 15 | 1.1 |
| 12 | | 20 | 0.7 |
| 13 | | 25 | 0.5 |
| 14 | | 30 | 0.4 |

EXAMPLE 6

The dyeing equipment in Example 1 is also used in this Example for dyeing a warp knit (8 in. open width×70 in.) from a 50 denier, round 2.9 dpf 66 nylon fiber with a four component pre-metallized dye mixture. In Part A, a conventional dye procedure is used and, in Part B, a process in accordance with the invention is used. Dye uniformity ratings from the two dyeings are compared.

PART A (Comparative)

54 grams of the fabric described above is scoured and the dye bath set as in Example 1 to make a 45:1 liquor ratio (weight of bath to weight of fabric). The pH is adjusted to 5.0 with MSP and phosphoric acid and the fabric is set into rapid motion by the action of the jet nozzle.

Separately 0.028 grams of Intralan Yellow 2BRL S (Crompton and Knowles Corp.) (100%) and 0.0084 grams of Intralan Bordeaux RLB (Crompton and Knowles Corp.) (100%); and 0.06 grams of C. I. Acid Black 107 and 0.18 grams of C. I. Acid Black 132, all pre-metallized dyes, are dissolved in 200 ml of distilled water. This is calculated to provide dye-on-fiber of 0.0518%; 0.0156%; 0.11% and 0.33% of each of the respective dyes, assuming complete exhaustion of the dye. The dye solution is then added to the dyeing bath in the conventional manner at 80° F. (26.7° C.). Under these conditions the fabric is fully flooded by the dyeing bath. The dyeing bath is raised at 2° F./min. (1.1° C./min.) to 205° F. (96.1° C.) then held at temperature for 30 minutes. The fabric is overflow rinsed, removed from the dyeing machine, then air dried.

The result is a colorless dyeing bath and a level (i.e., not blotchy) gray dyed warp knit fabric but with numerous light and dark streaks and bands. The dye uniformity rating for this fabric is 2.0. Relative dye strength is measured on the underlap side of the dried fabric and this fabric is designated as having 100% relative dye strength.

PART B

The amount and type of fabric, dyeing equipment, and scouring conditions as in Part A are also used in this example.

The dyeing bath is then set as in Example 1 at and the pH is adjusted to 5.0 with monosodiumphosphate (MSP) and phosphoric acid. Under these conditions the fabric is fully flooded by the dyeing bath. The fabric is set into rapid motion by pumping the dyeing bath thru the jet nozzle. The temperature of the dyeing bath is raised rapidly by 5° F./min. (2.8° C./min.) to 205° F. (96.1° C.).

Separately the same four component dye shade detailed in the Part A is prepared in 200 ml of distilled water to provide the same percentages of dyes, dye-on-fabric, assuming complete exhaustion. Using the same equipment as used in Example 1, the separately prepared dye solution is metered under the surface of the dyeing bath, with the bath at 205° F. (96.1° C.), at the rate of 5 ml/minute, over the 40 minute dye addition period. The percentage of total dye added per fabric turnover (machine cycle) is 0.08%. Then the fabric is overflow rinsed, removed from the dyeing machine, then air dried.

The result obtained is a level (i.e., not blotchy) gray dyeing with no noticeable streaks and a colorless dyeing bath. An increase in relative dye yield of 34% is measured on the underlap side with respect to the comparative dyeing described above in Part A. This fabric has a dye uniformity rating of 7.5.

EXAMPLE 7

The dyeing equipment described in Example 1 is used in this Example for a circular knit, tubular fabric (4½ in. tubular, 8½ in. open width×62 in.) from a 40 denier, trilobal 3.08 dpf 66 nylon fiber with Anthraquinone Milling Blue BL (C.I. Acid Blue 122) dye. In part A, a conventional dyeing procedure is used. Parts B, C and D illustrate processes in accordance with the invention where some of the dye is added into the bath before the bath is up to temperature, i.e., less than 100% of the dye is added into the bath during the rapid dye uptake phase.

PART A (Comparative)

50 grams of the fabric described above is scoured and overflow rinsed as in Example 1. The dyeing bath is again set as in Example 1 (50:1 liquor ratio) and the pH is adjusted to 5.0 with MSP and phosphoric acid. The fabric is set into rapid motion by the action of the jet nozzle.

Separately 0.5 grams of C.I. Acid Blue 122 is dissolved in 200 ml of distilled water to provide 1% dye-on-fabric assuming complete exhaustion. The dye solution is then added to the dyeing bath in the conventional manner at 80° F. (26.7° C.). Under these conditions the fabric is fully flooded by the dyeing bath. The dyeing bath raised at 2° F./min. (1.1° C./min.) 200° F. (93.3° C.) then held at 200° F. (93.3° C.) for 30 minutes. The dyeing bath is cooled at 5° F./min (2.8° C.) to 170° F. (76.7° C.), the fabric is overflow rinsed, removed from the dyeing machine, and then air dried.

The result is a level blue dyeing on the circular knit fabric and a colorless dyeing bath. The total cycle time is approximately 100 minutes. Relative dye strength is measured on the face of the dried fabric and this fabric designated as having 100% relative dye strength.

PART B

The type of fabric, the dyeing equipment and scouring procedures of Part A are repeated in this example except with 35 grams of the fabric.

The dyeing bath is then set at 80° F. (26.7° C.) and then the pH is adjusted to 5.0 with monosodium phosphate (MSP) and phosphoric acid. The fabric is set into rapid motion by the action of the jet nozzle.

Separately 0.35 g of Anthraquinone Milling Blue BL (C.I. Acid Blue 122) dye is dissolved in 200 ml of distilled water to provide 1% dye-on-fiber assuming complete exhaustion of the dye. 40 ml of the 200 ml of the separately prepared dye solution (20% of the total) is diluted to 125 ml is metered under the surface of the dyeing bath as in Example 1, with the bath at 80° F. (26.7° C.), at the rate of 5 ml/minute over 25 minutes while the bath temperature is raised to 205° F. (96.1° C.) at 5° F./min (2.8° C./min.). In this Example, the beginning of the dye addition period does not coincide with the beginning of the rapid dye uptake phase which begins when the dye transition temperature is reached. There is a noticeable build-up of dye in the bath under these conditions.

When the bath reached 205° F. (96.1° C.), which is well above the dye transition temperature, the remaining 160 ml of the original dye solution (80% of the total), diluted to 200 ml, is metered under the surface of the dyeing bath at the rate of 5 ml/min. over 40 minutes. Thus, at least about 80% of the dye is added during the rapid dye uptake phase when the bath is above the dye transition temperature. The percentage of total dye added per fabric turnover (machine cycle) during this period in which the second volume of dye is metered is 0.067%. The dyeing bath is then cooled, the dyed fabric overflow rinsed, removed from the dyeing machine, air dried as in Example 1.

The result obtained is a level blue dyeing on the nylon warp knit and a colorless dyeing bath. The total cycle time is approximately 72 minutes. An increase in relative dye yield of 27% is measured on the face of the dried fabric compared to the comparative dyeing of Part A described above.

PART C

The amount and type of fabric and the dyeing equipment and procedure described in Part B are used except that 70 ml of the original 200 ml solution of dye (35%) is diluted to 125 ml. This diluted solution is metered at the rate of 5 ml/min., as in Part B, starting with the bath at 80° F. (26.7° C.) while raising the bath temperature to 205° F. (96.1° C.) at 5° F./min. (2.8° C./min.) over 25 minutes. There is a noticeable build-up of dye in the bath.

When the bath reached 205° F. (96.1° C.), the remaining 130 ml of the original dye solution (65%), diluted to 200 ml, is metered at the rate of 5 ml/min. over 40 minutes. Thus, at least about 65% of the dye is added to the bath during the rapid dye uptake phase. The percentage of total dye added per fabric turnover (machine cycle) during this period in which the second volume of dye is metered is 0.054%.

The dyeing bath is cooled, the dyed fabric overflow rinsed, removed from the dyeing machine, and air dried as in Part B with equivalent results except that the increase in dye yield is now 21% compared to the conventional control dyeing. The total cycle time is approximately 72 minutes.

PART D

The amount and type of fabric and the dyeing equipment and procedure described in Part B is repeated except that 100 ml of the original 200 ml solution of dye (50%) is diluted to 125 ml. This diluted solution is metered at the rate of 5 ml/min., as in Part B, starting with the bath at 80° F. (26.7° C.) while raising the bath temperature to 205° F. (96.1° C.) at 5° F./min. (2.8° C./min.) over 25 minutes. There is a noticeable build-up of dye in the bath.

When the bath reached 205° F. (96.1° C.), the remaining 100 ml of the original dye solution (50%) diluted to 200 ml is metered at the rate of 5 ml/min. over 40 mins. Thus, at least about 50% of the dye is added during the rapid dye uptake phase. The percentage of total dye added per fabric turnover (machine cycle) during this period in which the second volume of dye is metered is 0.042%. The dyeing bath is cooled, the dyed fabric overflow rinsed, removed from the dyeing machine, and air dried as in Part B with equivalent results except that the increase in dye yield is now 11% compared to the conventional control dyeing. The total cycle time is approximately 72 minutes.

EXAMPLE 8

The dyeing equipment described in Example 1 is used for dyeing a jersey fabric tubing knit from trilobal 2.25 dpf 66 nylon yarn using a Lawson-Hemphill laboratory knitting machine. In Part A, a conventional dyeing procedure is used. Part B illustrates the process of the invention used to obtain a relative dye strength roughly equivalent to the dyed fabric of Part A with less dye being used in the process. (A lower relative dye content in the resulting fabric is also observed.) Cross-sectional photomicrographs of the dyed fabrics are made. FIG. 5 and 7 illustrates the fabric dyed by a conventional dyeing process (Part A) and FIG. 4 and 6 illustrates the fabric dyed by a process in accordance with the invention.

PART A (Comparative)

A 50 gram sample of the fabric described above is scoured, rinsed and the set with 2500 ml of distilled water and the pH is adjusted to 5.0 as in Example 1. The fabric is set into rapid motion by the action of the jet nozzle and run for 5 minutes.

Separately 1.5 g of C.I. Acid Blue 335 dye is dissolved in water to make a liquid concentrate. This is calculated to provide 3.0% dye-on-fiber assuming complete exhaustion. The concentrated dye solution is added to the bath. Under these conditions the fabric is fully flooded by the dyeing bath. The temperature is then raised to 205° F. (96.1° C.) at 3° F./min. (1.7° C./min.) and the fabric is dyed for 30 minutes. The bath is cooled, the fabric rinsed and air dried.

The result is a colorless dye bath and a level, navy blue fabric. Its relative dye strength taking an average of the face and back of the tubing and its relative dye content are each designated being 100%. FIGS. 5 and 7 are cross-sectional photomicrographs of the fabric.

PART B

With a 50 g sample of the fabric described above, the dyeing bath is then set with 2500 ml of distilled water and the pH is adjusted to 5.0 as in Example 1. The fabric is set into rapid motion by pumping the dyeing bath thru the jet nozzle. The temperature of the dyeing bath is then raised rapidly at 6° F./min. (3.3° C./min.) to the dyeing temperature. In this example, the temperature is held at 207° F. (97.2° C.) during the dye addition period.

Separately 1.05 g of C.I. Acid Blue 335 dye is dissolved in 200 ml of distilled water. This is calculated to provide 2.1% dye-on-fiber assuming complete exhaustion. Using the equipment described in Example 1, the separately prepared dye solution is metered under the surface of the dyeing bath, away from the moving fabric, at the rate of 5 ml/minute, which is equivalent to 0.05% dye/minute based on the weight of fabric. The percentage of total dye added per fabric turnover (machine cycle) is 0.08%. Under these conditions, there is never any visible built-up of dye in the bath during the period of dye solution addition which is completed in 42 minutes. The bath containing the dyed fabric is then cooled, the fabric is overflow rinsed, removed from the dyeing machine, and finally air dried as in Example 1.

The result is a colorless dye bath and a level, navy blue fabric. The relative dye strength of the fabric taking an average of the face and the back is 99.8%, roughly equivalent to the fabric of Part A, while its relative dye content is 73%. This is equivalent to a relative dye yield increase of 36.7%. FIGS. 4 and 6 are the cross-sectional photomicrograph of this fabric.

EXAMPLE 9

The dyeing equipment and procedures described in Example 1 is also used in this Example for dyeing a circular knit tubular fabric knit from 20/2 cotton count, 3 dpf, 1.5 inch long, autoclave crimp-set staple nylon yarn with the following dyes (% based on weight of fabric) together with the indicated UV inhibitor:

| | |
|---|---|
| 0.0275% | C.I. Acid Red 316 |
| 0.2145% | C.I. Acid Blue 239 |
| 0.1045% | Avilon Blue RW* |
| 0.066% | C.I. Acid Black 132 |
| 1.100% | CIBAFAST N ®* (UV inhibitor) |

*Ciba Geigy Corp.

The result is a cobalt blue color fabric with the outside being more deeply dyed than the inside and a colorless dyeing bath. The relative dye yield calculated from the average K/S value (average of the face and back surfaces of the knit tubing) increased by 76% compared to a control fabric dyed with the same dyes using a conventional procedure in a beck dyer. The relative dye content of the fabrics is roughly the same at 100% (invention) and 100.5% (control).

EXAMPLE 10

In this example, a carpet tufted from 2 ply, 1150 denier, trilobal 17 dpf bulked, continuous filament nylon yarn are dyed in an 8 inch Saucier Beck-dyeing Machine, manufactured by Saucier Stainless Steel Products, Minneapolis, Minn. Part A illustrates a conventional procedure and Part B illustrates a process of the invention.

PART A (Comparative)

The 450 grams of a carpet (8 in. by 75 in.) carpet as described above is placed over the winch of this beck, then sewn at the ends to form an endless "rope." The door is closed and then the carpet is scoured at 160° F. (71.1° C.) for 15 minutes using 0.1 g/l of MERPOL LFH ® (a liquid non-ionic detergent sold by E. I. du Pont de Nemours & Company) and 0.1 g/l of ammonium hydroxide. The fabric is overflow rinsed to remove all scouring agents, then the batch is dropped.

The dyeing bath is then set with 25 liters of distilled water at 55:1 liquor ratio (weight of bath to weight of fabric) at 80° F. (26.7° C.) and then the pH is adjusted to 5.0 with monosodium phosphate (MSP) and phosphoric acid. The fabric is set in motion by the turning action of the winch-reel.

Separately 4.5 grams of Anthraquinone Milling Blue BL (C.I. Acid Blue 122) is dissolved in 1000 ml of distilled water to provide 1% dye-on-fabric assuming complete exhaustion. The dye solution is then added to the dyeing bath. The dyeing bath is raised at 2° F./min. (1.1° C./min.) to 205° F. (96.1° C.) then held at 205° F. (96.1° C.) for 30 minutes. The dyeing bath is cooled at 5° F./min. (2.8° C.) to 170° F. (76.7° C.), the fabric is overflow rinsed, removed from the dyeing machine, then air dried.

The result is a level blue dyeing on the nylon carpet and a colorless dyeing bath. Relative dye strength is measured on the face of the tufted carpet and this carpet is designated as having 100% relative dye strength.

PART B

The amount and type of carpet, dyeing equipment, and scouring conditions used in Part A are again used in this Example.

In this Example, dyeing bath is again set with a 55:1 liquor ratio at 80° F. (26.7° C.) and then the pH is adjusted to 5.0 with monosodium phosphate (MSP) and phosphoric acid. The fabric is set in motion by the turning action of the winch-reel. The temperature of the dyeing bath is then raised rapidly by 5° F./min. (2.8° C./min.) to the dyeing temperature. In this example, the dyeing temperature is held nearly constant at about 200° F. (93.3° C.) during the dye addition period as described below.

Separately 4.5 g of Anthraquinone Milling Blue BL (C. I. Acid Blue 122) dye is dissolved in 1000 ml of distilled water to provide -1% dye-on-fiber assuming complete exhaustion of the dye. Using a precision (~1% accuracy) MANOSTAT COMPULAB liquid metering pump sold by Manostat Corporation of New York, N.Y., the separately prepared dye solution is metered under the surface of the dyeing bath away from the moving fabric at the rate of 25 ml/minute which is equivalent to 0.025% dye/minute based on the weight of the fabric. The percentage of total dye added per carpet turnover is 0.08%. Under these conditions there is never any visible buildup of dye in the dyeing bath during the dye addition period which is complete in 40 minutes.

The dyeing bath is then cooled at 5° F./min. (2.8° C./min.) to 170° F. (76.7° C.), then the fabric is overflow rinsed, removed from the dyeing machine, then air dried.

The result obtained is a level blue dyeing on the carpet and a colorless dyeing bath. The dye yield is increased by 98% relative to the comparative sample prepared in Part A above.

EXAMPLE 11

In this example, a carpet tufted from 3.75 cotton count, trilobal, 18 dpf, bulked, staple nylon yarn is dyed in the same equipment as used in Example 10. Part A illustrates a conventional procedure and Part B illustrates a process in accordance with the invention.

PART A (Comparative)

The 560 grams of a carpet (9 inches by 60 inches) as described above is scoured and rinsed as in Example 10.

The dyeing bath is then set with 11,000 ml of distilled water at 20:1 liquor ratio (weight of bath to weight of carpet) at 80° F. (26.7° C.) and then the pH is adjusted to 6.0 with monosodium phosphate (MSP). The carpet is set in motion by the turning action of the winch-reel.

Separately 0.84 grams each of C.I. Acid Orange 156, C.I. Acid Red 361 and C.I. Acid Blue 277 are dissolved in 100 ml of distilled water to provide 0.45% dye-on-carpet assuming complete exhaustion of the dye. The dye solution is then added to the dyeing bath. The dyeing bath is raised at 3° F./min. (1.7° C./min. to 212° F. (100° C.) then held at 212° F. (100° C.) for 1 hour. The dyeing bath is dropped while at 212° F. (100° C.), the carpet is overflowed rinsed with cold water and the dyeing bath is dropped again. The carpet is removed from the dyeing machine, water extracted and then air dried.

The result is a level medium brown dyeing on the nylon carpet and a colorless dyeing bath.

PART B

The amount and type of carpet, dyeing equipment and scouring conditions used in Part A are again used in this Example.

In this Example, dyeing bath is again set with 1,000 ml of distilled water at 20:1 liquor ratio (weight of bath to weight of carpet) at 80° F. (26.7° C.) and then the pH is again adjusted to 6.0 with monosodium phosphate (MSP), trisodiumpyrophosphate (TSPP) and phosphoric acid. With the carpet moving by the turning action of the winch-reel, the temperature of the dyeing bath is then raised rapidly by approximately 5° F./minute (2.8° C./minute) to the dyeing temperature 212° F. (100° C.).

Separately 0.84 grams each of C.I Acid Orange 156, C.I. Acid Red 361, and C.I. Acid Blue 277 are dissolved in 100 ml of distilled water and then diluted to a total volume of 200 ml to provide 0.45% dye-on-carpet assuming complete exhaustion of the dye.

Using a precision (~1% accuracy) MANOSTAT COMPULAB liquid metering pump sold by Manostat Corporation of New York, N.Y., the separately prepared dye solution is metered under the surface of the dyeing bath away from the moving carpet at the rate of 5 ml/min. which is equivalent to 0.011% dye/minute based on the weight of the carpet. The percentage of total dye added per carpet turnover (machine cycle) is 0.08%. Under these conditions there is never any visible buildup of dye in the dyeing bath during the period of dye addition which is completed in 40 minutes. After completion of dye addition, the bath is run for 15 minutes at about 212° F. (100° C.). The hot dyeing bath is dropped, the carpet is overflowed rinsed with cold water and the dyeing bath is dropped again. The carpet is removed from the dyeing machine, water extracted and then air dried.

The result is a level medium brown dyeing on the nylon carpet and a colorless dyeing bath.

EXAMPLE 12

25 grams of a woven fabric (64 in. long'8½ in. wide) from a warp of 40 denier, round 1.18 dpf, semi-dull 66 nylon fiber and a filling of 2 ply, 50 denier, 0.76 dpf, round, semi-dull 66 nylon Air-Jet textured yarns are sewn to form a tube and are scoured and dyed with Anthraquinone Milling Blue BL (C.I. Acid Blue 122) as in Example 4, Part A (Comparative) to provide a comparative dyeing. In addition, the same fabric is scoured and dyed with the same dye in accordance with the procedures of Example 4, Part B to provide a dyeing in accordance with the invention.

The resulting level blue dyeing on the nylon woven fabric in accordance with the invention showed an increase in dye yield of 12 to 15% on the face of the fabric relative to the comparative (control) dyeing. Photomicrographs showed that the fiber of the dyes fabric is asymmetrically ring-dyed, typical of the preferred form of invention using dyes such that the transfer is less than 10%.

EXAMPLE 13

In this Example, conditions are varied to illustrate the effects on dye uptake during the process and on dye yield of the dyed fabric. pH (4 vs. 6), temperature (180 vs. 205° F.; 82.2 vs. 96.1° C.) and time at temperature after addition of dye (15 vs. 45 minutes) are varied as detailed in Table 4.

For Items 1–7, the amount and type of fabric, the dyeing equipment and procedure detailed in Example 5, Part B are repeated first to scour the fabric and then to apply 2% on weight of fabric of C.I. Acid Violet 48. The pH is adjusted to 4 or 6 as shown in Table 4 with monosodium phosphate (MSP) and phosphoric acid. A previously prepared solution of 0.70 g C.I. Acid Violet 48 in 200 ml of distilled water is added to the dyeing bath at a rate of 5 ml/minute and samples of the dyeing bath are collected at various temperatures/times during the process. The amount of dye per minute is 0.05% dye/minute and percentage of total dye added per fabric turnover (machine cycle) is 0.08%. The concentration of C.I. Acid Violet 48 is determined spectrophotometrically and the results are summarized in FIG. 1 for Items 1 (pH 4) and 5 (pH 6) illustrating the 15 minute time at temperature.

Four comparative Items 1c, 2c, 3c, and 4c are prepared using the same type and amount of fabric used for Items 1–7. The same procedures are used for scouring and preparing the items for dyeing. Four control dyeings are run, one at each of the pH and temperature conditions of Items 1–7, namely:

1c pH 4; 180° F. (82.2° C.);
2c pH 4; 205° F. (96.1° C.);
3c pH 6; 180° F. (82.2° C.);
4c pH 6; 205° F. (96.1° C.).

The same liquid dye concentrate is used as in Items 1–8, but for each of the Items 1c–4c, the dye is added and the dyeing bath is raised at 2° F./min. (1.1° C./min.) to the specified temperature, then held at temperature for 30 minutes.

Figure 2:
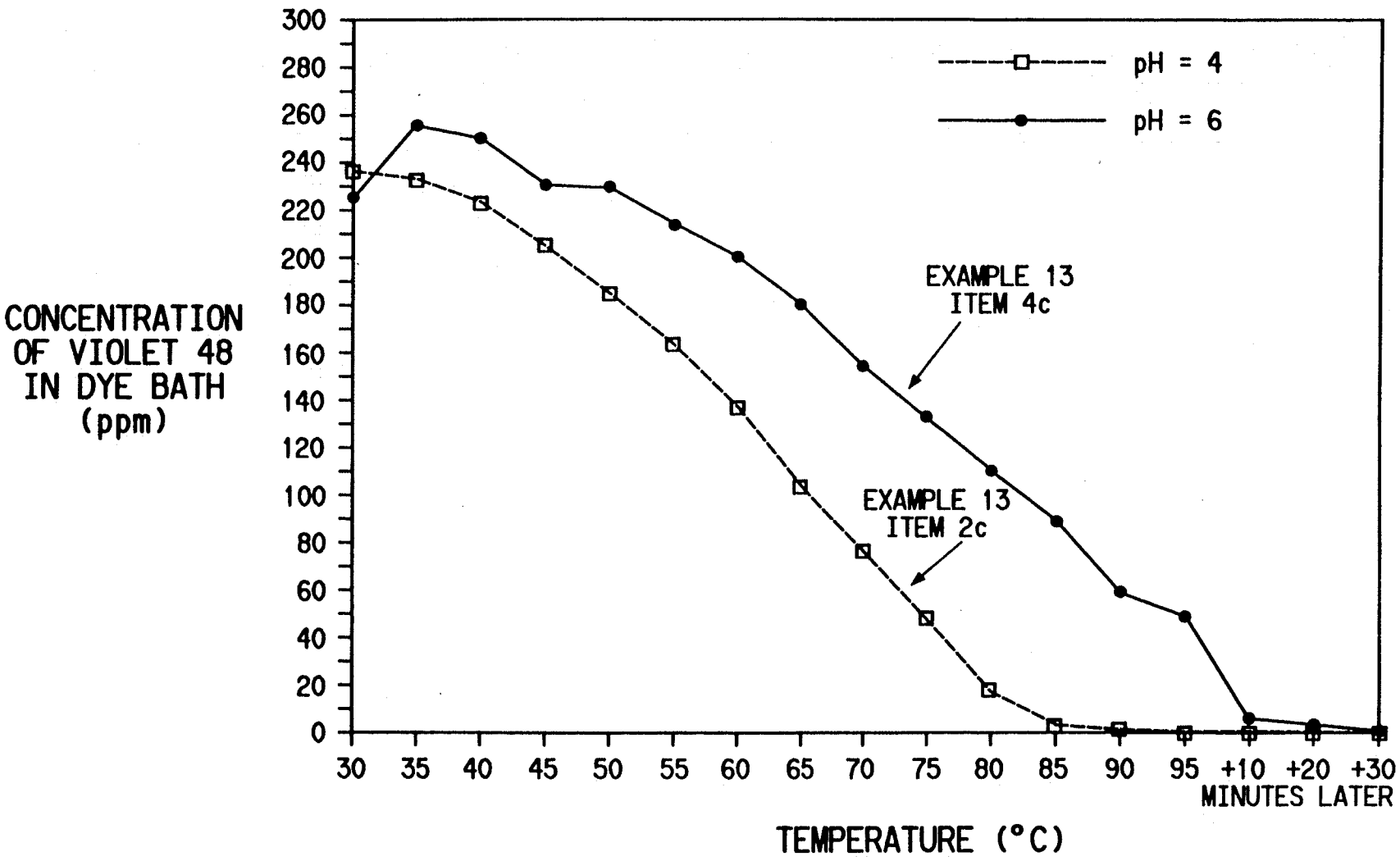
FIG. 2 is a graphical representation of the concentration of dye in a dye bath with respect to temperature for a lab scale jet dyeing process run in a conventional manner (Example 13, Items 2c and 4c)

For Items 2c and 4c, bath samples are collected at various temperatures/times during the dyeing. The concentration of C.I. Acid Violet 48 is determined and the results are summarized in FIG. 2. The bath is cooled at 5° F. (2.8° C.) to 170° F. (76.7° C.), then the dyed fabric is overflow rinsed by addition of cool water, removed from the dyeing machine and air dried.

The dye strength of each Item 1–7 are measured on the face of the fabric against its respective control. Results are detailed in Table 4.

TABLE 4

| ITEM | COMP. | PH | TEMPERATURE °F. | TEMPERATURE (°C.) | TIME AT TEMP. | % DYE YIELD INCREASE |
|---|---|---|---|---|---|---|
| 1 | 1c | 4 | 180 | (82.2) | 15 | 41 |
| 2 | 1c | 4 | 180 | (82.2) | 45 | 34 |
| 3 | 2c | 4 | 205 | (96.1) | 15 | 49 |
| 4 | 2c | 4 | 205 | (96.1) | 45 | 46 |
| 5 | 3c | 6 | 180 | (82.2) | 15 | 4 |
| 6 | 4c | 6 | 205 | (96.1) | 15 | 13 |
| 7 | 4c | 6 | 205 | (96.1) | 45 | 9 |

EXAMPLE 14

The amount and type of fabric and the dyeing equipment and procedure detailed in Example 13, Items 1–7 is repeated first to scour the fabric and then to apply 2% on weight of fabric of C.I. Acid Violet 48. The rate of dye addition is decreased to illustrate the effects on dye uptake during the processes and on dye yield of the dyed fabric compared with the rate in Example 13. Items 1 and 2 with different temperature (180 vs. 205° F.; 82.2 vs. 96.1° C.) at pH 6 are illustrated.

Figure 3:
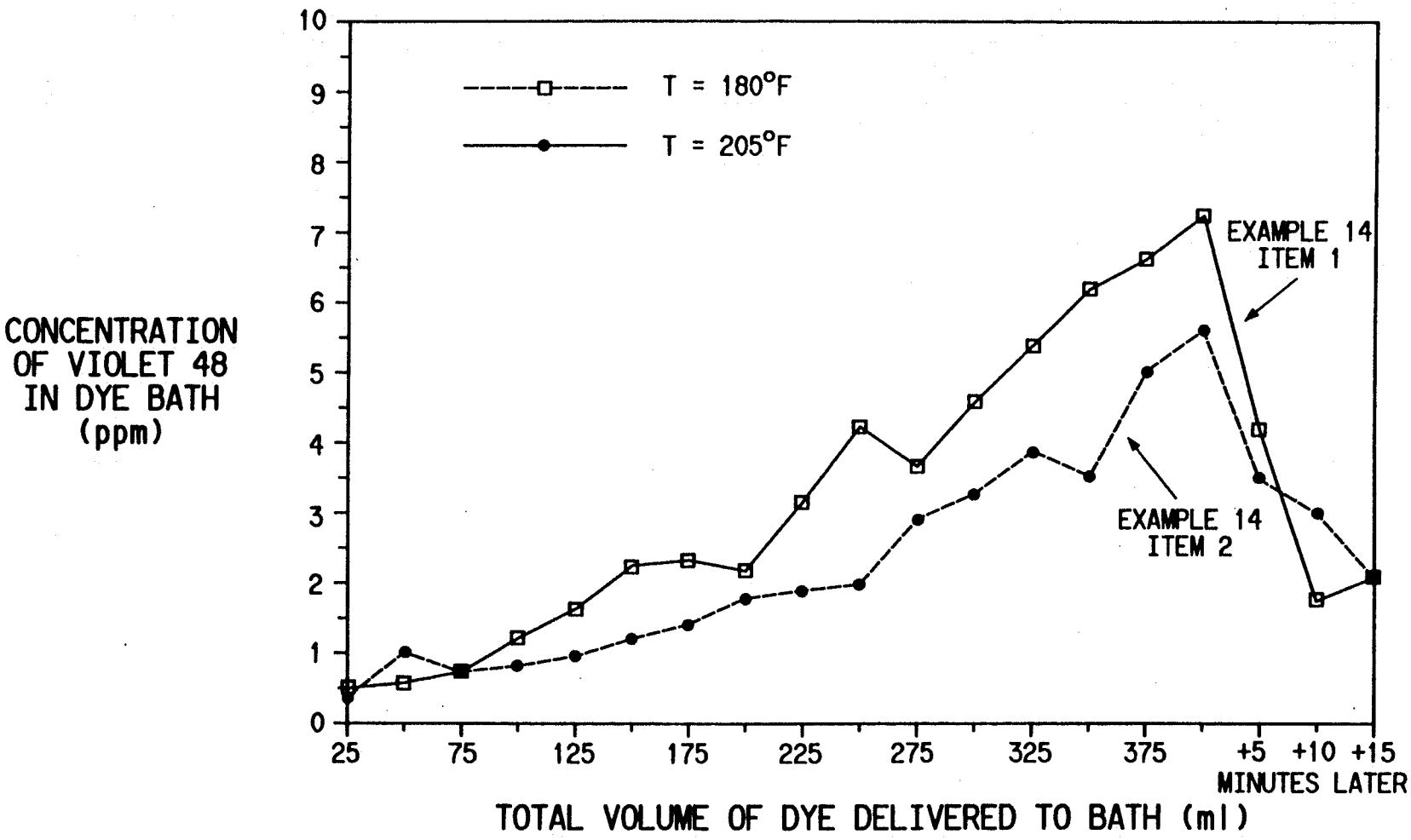
FIG. 3 is a graphical representation of the concentration of dye in a dye bath with respect to volume of dye concentrate added to the bath for another lab scale jet dyeing process in accordance with the invention (Example 14, Items 1 and 2)

In this example, the dyeing baths are set and the pH is adjusted to 6 with monosodium phosphate (MSP) and phosphoric acid. The same amount of dye, 0.70 g of C.I. Acid Violet 48, is dissolved in 400 ml of distilled water and added at 5 ml/min. into the bath. Since the amount of dye is the same but the volume of solution is doubled, the rate of addition is half the rate of Example 13; i.e., 0.025% dye/minute and 0.04% total dye per turnover. Samples of the dyeing bath are collected at various times during the process and up to minutes after completion of addition of dye in the bath and the concentration of C.I. Acid Violet 48 is determined spectrophotometrically and the results are summarized in FIG. 3.

EXAMPLE 15

Using larger scale dyeing equipment, full width (60 inches) elastic and non-elastic warp knit tricot fabric and half width (63 inches) elastic warp knit raschel fabric are dyed by the process of this invention. Part I illustrates the process used to prepare the fabrics prior to dyeing and Parts II, III and IV illustrate the dyeing of these types of fabrics.

PART I

The warp knit fabrics described in this example are prepared for dyeing using an open width scouring range sold by Jawetex Ag of Rorschasch, Switzerland. The fabrics are processed at 10 yards/minute through the wash tank holding 2,000 liters of water at 180° F. (82.2° C.), which contained 0.5 gram/liter of MERPOL LFH® (a liquid non-ionic detergent sold by E. I. Du Pont de Nemours & Company, Inc. of Wilmington, Del.) then through the rinse tank holding 540 liters of water heated to the same temperature. The scoured fabrics are dried and heat set in one pass at 385° F. (196.1° C.) for 30 seconds using a 4 box (10 feet each) pin tenter sold by Bruckner Machinery Corp. of Spartanburg, S.C. The edges are trimmed during heat setting to minimize edge curling during dyeing.

PART II 9,000 grams of warp knit fabric (75 linear yards; 60 inch width) from a 40 denier, trilobal 3.1 dpf 66 nylon fiber, after preparation as described in Part I, are introduced into a fully-flooded Hisaka Jet Dyer, Model V-L sold by Mascoe Systems Corp. of Mauldin, S.C. The fabric is put through the jet nozzle (70 mm) then sewn carefully at the ends to avoid bias seaming. The fabric is scoured under conventional conditions at 180° F. (82.2° C.) for 20 minutes using 400 liters of water containing 0.5 g/l of MERPOL LFH®. The fabric is overflow rinsed to remove all scouring chemicals.

The dyeing bath is then set with 400 liters of water at a 44:1 liquor ratio (weight of bath to weight of fabric) at 80° F. (26.7° C.) then the pH is adjusted to 5.2 with 0.4 g/l of monosodium phosphate (MSP). Under these conditions the fabric is fully flooded by the dyeing bath. The fabric is set into motion (1 turnover/min) by pumping the dyeing bath through the jet nozzle (8 pounds pressure). The temperature of the dyeing bath is raised rapidly by 7° F./min. (3.9° C./min.) to the dyeing temperature. In this example, the dyeing temperature is held nearly constant at about 180° F. (82.2° C.) during the dye addition period as described below.

Separately 90.0 grams of Anthraquinone Milling Blue BL (C. I. Acid Blue 122) is dissolved in 9 liters of warm water. This is calculated to provide 1% dye-on-fabric assuming complete exhaustion of the dye. Using a (~1% accuracy) MANOSTAT COMPULAB liquid metering pump sold by Manostat Corporation of New York, N.Y., the separately prepared dye solution (10 g/l) is metered into the dyeing machine at the inlet of the circulation pump. A pumping rate of 225 ml/min. is used, which is equivalent to 0.025% dye/minute based on weight of fabric. The percentage of total dye added per fabric turnover (machine cycle) is 1.67%. Under these conditions there is only a slight visible build up of dye during the period of dye addition which is complete in 40 minutes. After an additional 10 minutes the dyeing bath is colorless and the pH is 5.5. The dyeing bath is then cooled at 5° F./min. (2.8° C./min.), overflow rinsed, removed from the dyeing machine and then dried at wet width on a pin tenter at 250° F. (121.1° C.). Visual inspection of the dyed fabric showed a level dyeing.

PART III

The fabric preparation described in Part I and the dyeing procedure described in Part II of this example are used to dye 12,600 grams (51 linear yards; 60 inches width) of a warp knit tricot fabric from 80 weight % 40 denier trilobal 3.1 dpf 66 nylon fiber and 20 weight % 40 denier LYCRA® spandex (E. I. Du Pont de Nemours & Company, Inc.).

Separately, 126.0 grams of Anthraquinone Milling Blue BL (C.I. Acid Blue 122) are dissolved in 12.6 liters of warm water. This is calculated to provide 1% dye-on-fabric (1.25% on weight of nylon fiber) assuming complete exhaustion of the dye. The separately prepared dye solution (10 g/l) is metered at 315 ml/min., which is equivalent to 0.025% dye/minute. The percentage of total dye added per fabric turnover (machine cycle) is 1.67%. Visual inspection of the dyed fabric showed a level dyeing.

PART IV

The fabric preparation described in Part I and the dyeing procedure described in Part II of this example are used to dye 11,200 grams (44 linear yards; 63 inch width) of a warp knit raschel fabric from 87 weight % 40 denier trilobal 3.1 dpf 66 nylon and 13 weight % 140 denier LYCRA® spandex (E. I. du Pont de Nemours & Company, Inc.).

Separately, 112.0 grams of Anthraquinone Milling Blue BL (C. I. Acid Blue 122) are dissolved in 1.2 liters of warm water. This is calculated to provide 1% dye-on-fabric (1.15% on weight of nylon fiber) assuming complete exhaustion of dye. The separately prepared dye solution (10 g/l) is metered at 5 ml/min., which is equivalent to 0.021% dye/minute. The percentage of total dye added per fabric turnover (machine cycle) is 1.67%. Visual inspection of the dyed fabric showed a level dyeing.

EXAMPLE 16

200 yards (100 lbs.) of a 93 inch Wide warp knit fabric from a 50 denier, round 2.9 dpf 66 nylon fiber is introduced into a Hisaka FL-1 Jet Dyeing Machine sold by Mascoe Systems Corp. of Mauldin, S.C. containing 325 liters of water to a liquor:fabric ratio of about 7:1. Under these conditions, the fabric is only partially immersed. The bath is set with 0.5%, on weight of fabric, of trisodium pyrophosphate and 0.5%, on weight of fabric, of POLYSCOUR LF® a detergent manufactured by Apollo Chemical Co., Burlington, N.C. The bath temperature is raised to 180° F. (82.2° C.) at 5° F. (2.8° C.) per minute. The fabric is scoured for 10 minutes at 180° F. (82.2° C.) then rinsed. A fresh bath is set at 80° F. (26.7° C.) and 0.2% on weight of fabric of ALBEGAL B®, a leveling agent manufactured by Ciba Geigy Corp., Greensboro, N.C., and 0.349% on weight of fabric of monosodium phosphate are added. The temperature is raised to 200° F. (93.3° C.) at 5° F. (2.8° C.) to 7° F. (3.9° C.) per minute. Fabric turnover rate is 30 seconds per revolution during the entire process.

Separately, the following dyes and 1.5% CIBAFAST N®, an ultraviolet light absorber manufactured by Ciba Geigy Corp, are mixed in 19 liters of water with % being based on fabric weight:

| | |
|---|---|
| 1.05119% | Intralan Yellow 3RL* |
| 0.00664% | Intralan Bordeaux EL* |
| 0.01892% | C.I. Acid Blue 171 |
| 0.09220% | C.I. Acid Black 132 |

*Ciba Geigy Corp.

The dye solution with CIBAFAST N® is metered in through the inlet side of the circulation pump of the Hisaka Jet Dyer over 80 minutes which is equivalent to 0.013% dye/minute based on the weight of the fabric. The rate of addition supplies 0.63% of the total dye solution per fabric revolution (machine cycle).

The bath is then cooled to 160° F. (71.1° C.), a sample is taken to confirm that the desired color (shade) was achieved. The fabric is then rinsed and dried in the conventional manner.

Inspection showed that the fabric had commercially acceptable visual levelness from side to side and had commercially acceptable uniformity.

The dyed/dried fabric is subsequently napped and sheared in the conventional manner to produce a finished fabric suitable for use as automotive headliner cloth. The finished fabric is commercially acceptable as regards uniformity and side to side color levelness.

EXAMPLE 17

A warp knit fabric of 40 denier, 2 dpf, trilobal bright nylon 66 yarn is used in this example to illustrate beam dying in accordance with the invention. Approximately 20 yards (950 grams) of 17 inch wide fabric to be dyed are wound firmly and smoothly around a 4 in. diameter, 18 inch-long dyeing beam, which has already been covered with 3 layers of cheese cloth. The fabric is wound with the face of the fabric outward and is clamped at both ends of the beam. The tube and wound fabric are secured in a laboratory dyer built by Burlington Engineering Company. The fabric is scoured conventionally at 185° F. (85° C.) for 20 min. using 0.5 grams per liter MERPOL LFH® in 38 liters of water. The fabric is overflow rinsed to remove all scouring agents and then the bath is dropped.

The dyeing bath is then set with 38 liters of water at a 40:1 liquor ratio (weight of bath to weight of fabric) at 80° F. (26.7° C.) and then the pH is adjusted to 5.0 with monosodium phosphate (MSP) and phosphoric acid. The bath is pumped at full pump pressure through the dyeing beam and fabric. The temperature of the dyeing bath is raised rapidly by 7° F. (3.9° C.) per minute to 180° F. (82.2° C.).

Separately 9.5 grams of Anthraquinone Milling Blue BL (C.I. Acid Blue 122) dye is dissolved in 3800 ml of water to form a dye concentrate. Using the precision metering pump of Example 1, the separately prepared dye solution is metered into the expansion tank of the beam dyer at the rate of 95 ml/min for 40 minutes. Under these conditions, there is almost no visible build up of dye in the dyeing bath during the period of dye addition. The dyeing bath is cooled and drained. The fabric is overflow rinsed, removed from the dyeing machines, then air dried.

The result obtained is a level blue dyeing of the nylon warp knit and a colorless dyeing bath.

We claim:

1. A process for dyeing a fibrous article containing fibers of a polyamide polymer with at least one anionic dye comprising:

immersing said article in an aqueous liquid dyeing bath;

heating said dyeing bath and said article in said dyeing bath to a temperature at least equal to the dyeing transition temperature of said fiber of polyamide polymer;

adding said anionic dye to said dyeing bath as a miscible liquid concentrate at a dye addition rate during a dye addition period, said miscible liquid concentrate containing water as a solvent, at least about 33% of the total dye to be applied during said process being added while said dyeing bath and said article are at a temperature at least equal to said dyeing transition temperature; and stirring said dyeing bath during said dye addition period and while said dyeing bath and said article are at a temperature at least equal to said dyeing transition temperature to mix said dye concentrate into said dyeing bath to form a dilute dye solution and to provide a flow of said dilute dye solution relative to said article to cause said dye to be transported to said article, said stirring further providing, on the average, essentially uniform dye transport of said anionic dye to said article;

said dye addition rate being about 0.0005 to about 0.5% dye/minute based on the weight of said article.

2. The process of claim 1 further comprising maintaining the pH and temperature of said dyeing bath so that said anionic dye transfers less than about 10%.

3. The process of claim 1 wherein said stirring is performed generally constantly and at a constant rate in said dyeing bath at least while said dyeing bath and said article are at a temperature at least equal to said dyeing transition temperature.

4. The process of claim 1 wherein said dye is added continuously and at a constant rate during said dye addition period.

5. The process of claim 1 wherein at least about 50% of said total dye to be applied during said process is added while said dyeing bath and said article are at a temperature at least equal to said dyeing transition temperature.

6. The process of claim 1 further comprising maintaining the temperature of said dyeing bath and said article generally constant at a temperature at least equal to said dyeing transition temperature when said portion of said dye is being added to said bath.

7. The process of claim 1 further comprising maintaining the pH of said aqueous dyeing bath generally constant when said portion of said dye is added to said bath at a temperature at least equal to said dyeing transition temperature.

8. The process of claim 1 wherein said polyamide polymer is selected from the class consisting of aliphatic polyamide homopolymers and copolymers.

9. The process of claim 8 wherein said aliphatic polyamide is selected from the class consisting of aliphatic polyamides containing at least one of poly(hexamethylene adipamide) or poly(ϵ-caproamide) polymer units in an amount greater than about 60% by weight.

10. The process of claim 8 wherein said aliphatic polyamide contains at least about 85% poly(hexamethylene adipamide) units.

11. The process of claim 1 wherein at least some of said stirring is provided by a pump which circulates said dyeing bath.

12. The process of claim 11 wherein said liquid dye concentrated is added into said dyeing bath ahead of said pump to form said dilute dye solution.

13. The process of claim 12 wherein said liquid dye concentrate is added into said dyeing bath by a metering pump.

14. The process of claim 13 wherein said article is fabric in the form of an endless rope, said dye bath being provided in a jet dyeing machine having a jet nozzle, and said pump supplying said dilute dye solution to said jet nozzle to provide stirring while moving said fabric through said nozzle.

15. The process of claim 14 further comprising hydrosetting said fabric before dyeing.

16. The process of claim 1 wherein said article is carpet in the form of an endless rope and said dyeing bath is provided in a beck dyer.

17. An article containing polyamide fiber dyed by the process of claim 2.

18. A dyed fabric having front and back fabric surfaces and a fabric interior and comprising yarns each having outside fibers adjacent to a yarn outside surface and inside fibers in a yarn interior, said inside and outside fibers being comprised of fibers of a polyamide polymer, said dyed fabric containing at least one anionic dye, wherein said anionic dye is distributed in said fabric such that:

said fibers are asymmetrically ring-dyed; and said outside fibers contain more dye than do said inside fibers.

19. The dyed fabric of claim 17 wherein said polyamide polymer is selected from the class consisting of an aliphatic polyamide homopolymers and copolymers.

20. The dyed fabric of claim 19 wherein said aliphatic polyamide is selected from the class consisting of aliphatic polyamides containing at least one of poly(hexamethylene adipamide) or poly(ϵ-caproamide) polymer units in an amount greater than about 60% by weight.

21. The dyed fabric of claim 20 wherein said aliphatic polyamide contains at least about 85% poly(hexamethylene adipamide) units.

22. The dyed fabric of claim 17 wherein said fabric is selected from the class consisting of knitted and woven fabrics.

23. The dyed fabric of claim 18 wherein said fibers of a polyamide polymer comprise continuous filaments.

24. The dyed fabric of claim 17 wherein said dyed fabric is essentially free of end-to-end dye nonuniformities.

25. A process for dyeing a fibrous article containing fibers of a polyamide polymer with at least one anionic dye comprising:

immersing said article in an aqueous liquid dyeing bath;

heating said dyeing bath and said article in said dyeing bath to a temperature at least equal to the dyeing transition temperature of said fiber of polyamide polymer;

adding said anionic dye to said dyeing bath as a miscible liquid concentrate at a dye addition rate during a dye addition period, said miscible liquid concentrate containing water as a solvent, at least about 33% of the total dye to be applied during said process being added while said dyeing bath and said article are at a temperature at least equal to said dyeing transition temperature; and stirring said dyeing bath during said dye addition period and while said dyeing bath and said article are at a temperature at least equal to said dyeing transition temperature to mix said dye concentrate into said dyeing bath to form a dilute dye solution and to provide a flow of said dilute dye solution relative to said article to cause said dye to be transported to said article, said stirring further providing, on the average, essentially uniform dye transport of said anionic dye to said article;

said process being performed in a dyeing machine in which said stirring provides repetitive machine cycles;

said dye addition rate being adjusted so that an amount of dye between about 0.04% and about 7% of the total dye to be applied during said process is added to said dyeing bath during a machine cycle.

26. The process of claim 25 wherein said dye addition rate is adjusted so that an amount of dye between about 0.5% and 3% of the total dye to be applied during said process is added to said dyeing bath during a machine cycle.

27. The process of claim 25 further comprising maintaining the pH and temperature of said dyeing bath so that said anionic dye transfers less than about 10%.

* * * * *